US006704524B2

(12) United States Patent
Matsuguma et al.

(10) Patent No.: US 6,704,524 B2
(45) Date of Patent: Mar. 9, 2004

(54) METHOD OF DETECTING LIFE OF IMAGE BEARING MEMBER, IMAGE FORMING APPARATUS AND CARTRIDGE

(75) Inventors: Minoru Matsuguma, Shizuoka (JP); Yasuyuki Ishii, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/323,754

(22) Filed: Dec. 20, 2002

(65) Prior Publication Data

US 2003/0081958 A1 May 1, 2003

Related U.S. Application Data

(62) Division of application No. 10/178,229, filed on Jun. 25, 2002, which is a continuation of application No. 09/879,184, filed on Jun. 13, 2001, now abandoned.

(30) Foreign Application Priority Data

Jun. 15, 2000 (JP) ..... 2000/180629

(51) Int. Cl.[7] ..... G03G 15/00
(52) U.S. Cl. ..... 399/26; 399/24; 399/25
(58) Field of Search ..... 399/24, 25, 26, 399/31, 159

(56) References Cited

U.S. PATENT DOCUMENTS 5,278,612 A 1/1994 Inui ..... 399/26
5,420,671 A 5/1995 Kisu et al.
5,426,488 A 6/1995 Hayakawa et al.
5,835,818 A 11/1998 Hoshika et al. ..... 399/26
5,907,739 A 5/1999 Tsunemi et al. ..... 399/26

FOREIGN PATENT DOCUMENTS

| | | |
|---|---|---|
| JP | 63-149669 | 6/1988 |
| JP | 1-267667 | 10/1989 |
| JP | 4-51259 | 2/1992 |
| JP | 4-98265 | 3/1992 |
| JP | 5-188674 | 7/1993 |
| JP | 5-333626 | 12/1993 |
| JP | 6-130732 | 5/1994 |
| JP | 6-180518 | 6/1994 |

*Primary Examiner*—Hoang Ngo
(74) *Attorney, Agent, or Firm*—Fitzpatrick, Cella, Harper & Scinto

(57) ABSTRACT

A method of detecting the end of the life of an image bearing member has: a contact time detecting step of detecting the contact time when a developer carrying member that can be in contact with or have a clearance with an image bearing member contacts the image bearing member, the developer carrying member developing an electrostatic image formed in the image bearing member by a developer; and a determining step of determining the end of the life of the image bearing member in accordance with a parameter calculated by using the contact time detected in the contact time detecting step.

53 Claims, 9 Drawing Sheets

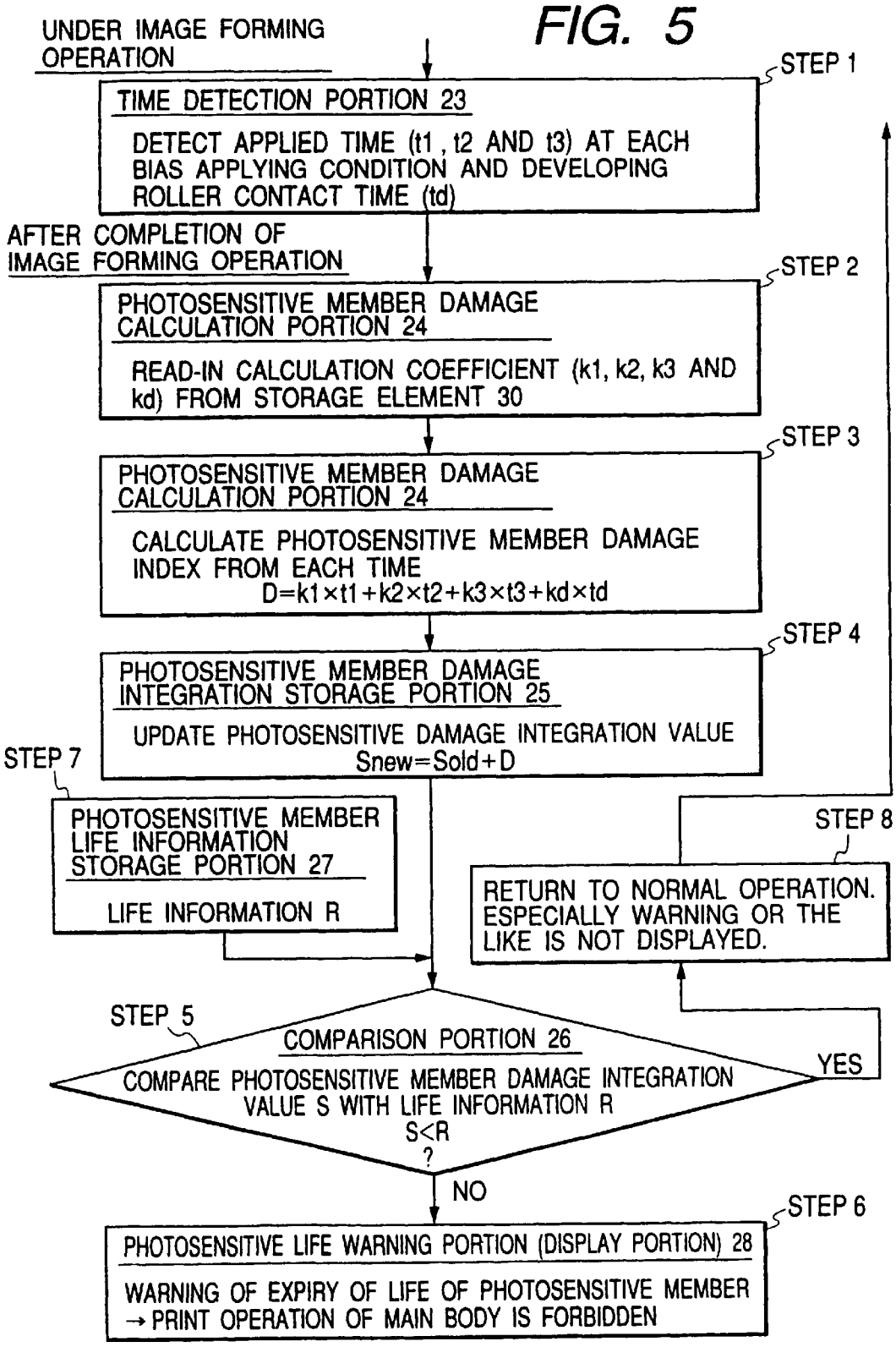
FIG. 5
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 7
PHOTOSENSITIVE MEMBER LIFE INFORMATION STORAGE PORTION 27
LIFE INFORMATION R
STEP 8
RETURN TO NORMAL OPERATION. ESPECIALLY WARNING OR THE LIKE IS NOT DISPLAYED.
STEP 5
COMPARISON PORTION 26
COMPARE PHOTOSENSITIVE MEMBER DAMAGE INTEGRATION VALUE S WITH LIFE INFORMATION R
S<R
?
YES
NO
STEP 6
PHOTOSENSITIVE LIFE WARNING PORTION (DISPLAY PORTION) 28
WARNING OF EXPIRY OF LIFE OF PHOTOSENSITIVE MEMBER
→ PRINT OPERATION OF MAIN BODY IS FORBIDDEN

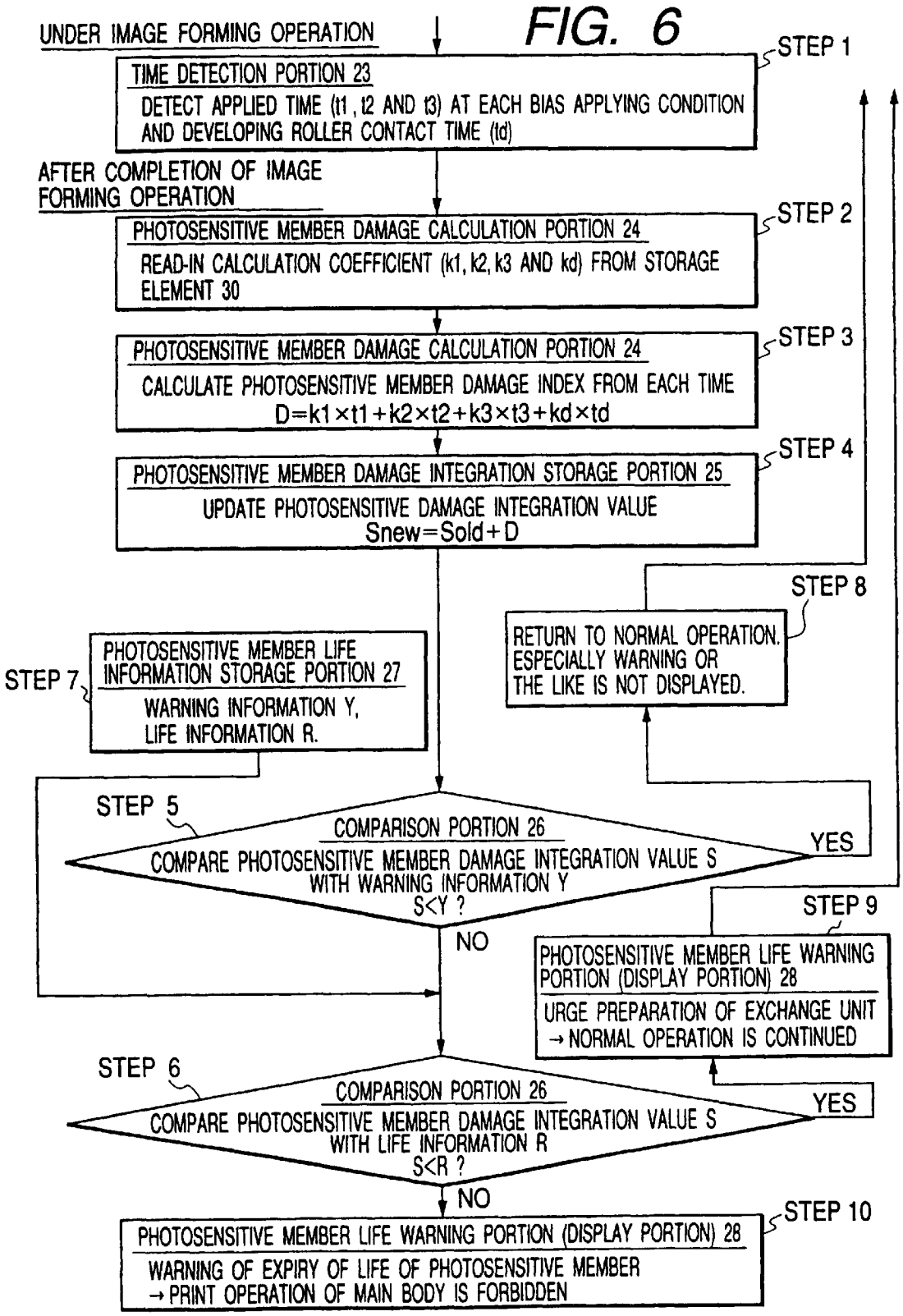
FIG. 6
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 8
RETURN TO NORMAL OPERATION. ESPECIALLY WARNING OR THE LIKE IS NOT DISPLAYED.
STEP 7
PHOTOSENSITIVE MEMBER LIFE INFORMATION STORAGE PORTION 27
WARNING INFORMATION Y, LIFE INFORMATION R.
STEP 5
COMPARISON PORTION 26
COMPARE PHOTOSENSITIVE MEMBER DAMAGE INTEGRATION VALUE S WITH WARNING INFORMATION Y
S<Y ?
YES
NO
STEP 9
PHOTOSENSITIVE MEMBER LIFE WARNING PORTION (DISPLAY PORTION) 28
URGE PREPARATION OF EXCHANGE UNIT
→NORMAL OPERATION IS CONTINUED
STEP 6
COMPARISON PORTION 26
COMPARE PHOTOSENSITIVE MEMBER DAMAGE INTEGRATION VALUE S WITH LIFE INFORMATION R
S<R ?
YES
NO
STEP 10
PHOTOSENSITIVE MEMBER LIFE WARNING PORTION (DISPLAY PORTION) 28
WARNING OF EXPIRY OF LIFE OF PHOTOSENSITIVE MEMBER
→PRINT OPERATION OF MAIN BODY IS FORBIDDEN

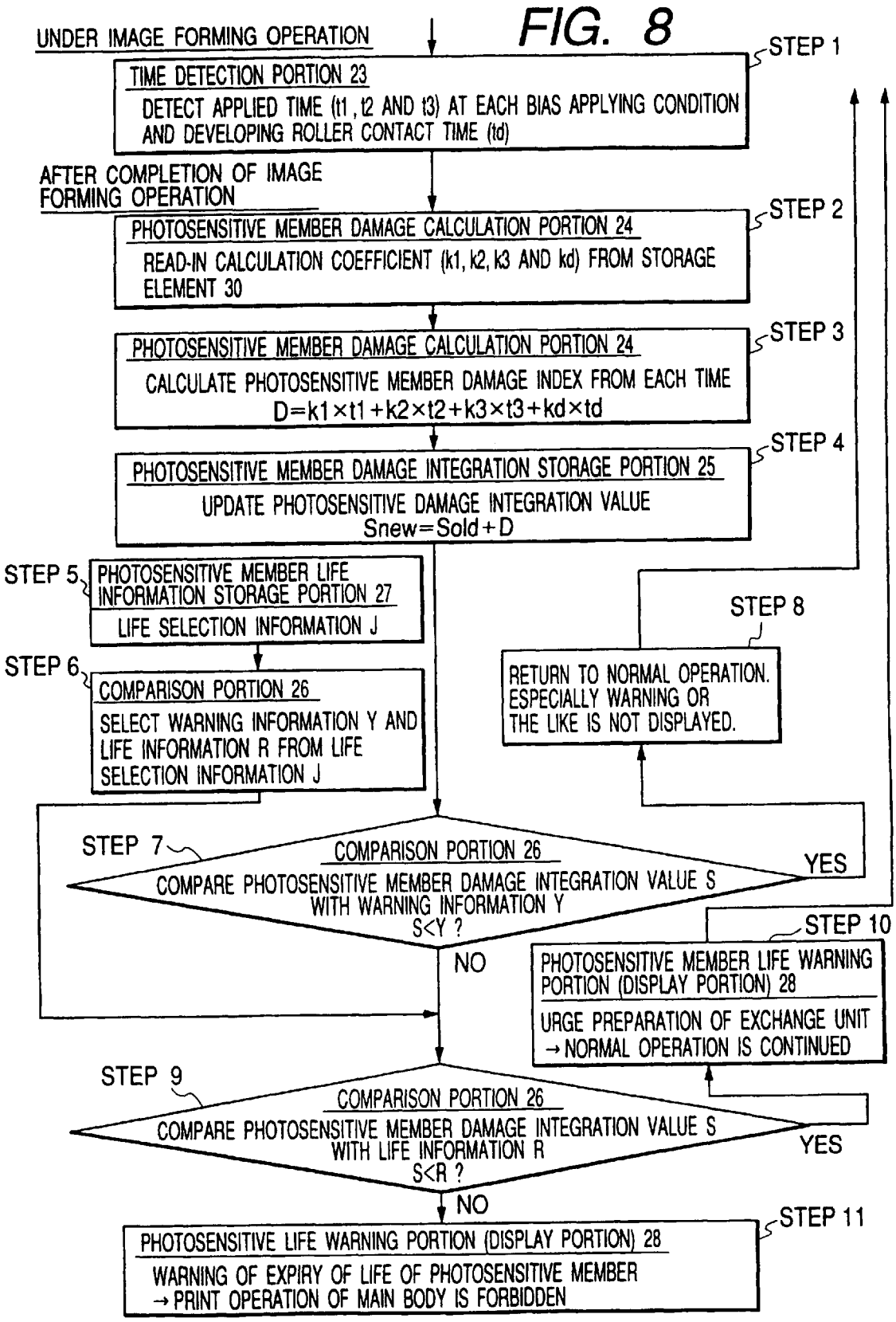
FIG. 8
UNDER IMAGE FORMING OPERATION
STEP 1
TIME DETECTION PORTION 23
DETECT APPLIED TIME (t1, t2 AND t3) AT EACH BIAS APPLYING CONDITION AND DEVELOPING ROLLER CONTACT TIME (td)
AFTER COMPLETION OF IMAGE FORMING OPERATION
STEP 2
PHOTOSENSITIVE MEMBER DAMAGE CALCULATION PORTION 24
READ-IN CALCULATION COEFFICIENT (k1, k2, k3 AND kd) FROM STORAGE ELEMENT 30
STEP 3
PHOTOSENSITIVE MEMBER DAMAGE CALCULATION PORTION 24
CALCULATE PHOTOSENSITIVE MEMBER DAMAGE INDEX FROM EACH TIME
D=k1×t1+k2×t2+k3×t3+kd×td
STEP 4
PHOTOSENSITIVE MEMBER DAMAGE INTEGRATION STORAGE PORTION 25
UPDATE PHOTOSENSITIVE DAMAGE INTEGRATION VALUE
Snew=Sold+D
STEP 5
PHOTOSENSITIVE MEMBER LIFE INFORMATION STORAGE PORTION 27
LIFE SELECTION INFORMATION J
STEP 6
COMPARISON PORTION 26
SELECT WARNING INFORMATION Y AND LIFE INFORMATION R FROM LIFE SELECTION INFORMATION J
STEP 8
RETURN TO NORMAL OPERATION. ESPECIALLY WARNING OR THE LIKE IS NOT DISPLAYED.
STEP 7
COMPARISON PORTION 26
COMPARE PHOTOSENSITIVE MEMBER DAMAGE INTEGRATION VALUE S WITH WARNING INFORMATION Y
S<Y ?
YES
NO
STEP 10
PHOTOSENSITIVE MEMBER LIFE WARNING PORTION (DISPLAY PORTION) 28
URGE PREPARATION OF EXCHANGE UNIT
→NORMAL OPERATION IS CONTINUED
STEP 9
COMPARISON PORTION 26
COMPARE PHOTOSENSITIVE MEMBER DAMAGE INTEGRATION VALUE S WITH LIFE INFORMATION R
S<R ?
YES
NO
STEP 11
PHOTOSENSITIVE LIFE WARNING PORTION (DISPLAY PORTION) 28
WARNING OF EXPIRY OF LIFE OF PHOTOSENSITIVE MEMBER
→PRINT OPERATION OF MAIN BODY IS FORBIDDEN

METHOD OF DETECTING LIFE OF IMAGE BEARING MEMBER, IMAGE FORMING APPARATUS AND CARTRIDGE

CROSS-REFERENCE

This application is a divisional application of U.S. patent application Ser. No. 10/178,229, filed Jun. 25, 2002, now allowed, which is a continuation of U.S. patent application Ser. No. 09/879,184, filed Jun. 13, 2001, now abandoned.

BACKGROUND OF THE INVENTION

1. Field of the Invention

The present invention generally relates to a method of detecting the life time of an image bearing member used in an image forming apparatus for forming an electrostatic latent image in an image bearing member by, for example, an electrophotographic system or an electrostatic recording system and visualizing the electrostatic latent image with a developer, to an image forming apparatus using the above method, and further, to a cartridge detachably attachable to the image forming apparatus.

Here, the image forming apparatus with the electrophotographic system include, for example, an electrophotographic copier, an electrophotographic printer (for example, an LED printer and a laser beam printer), and an electrophotographic facsimile.

The cartridge detachably attachable to the main body of the electrophotographic image forming apparatus includes a cartridge having at least one of an electrophotographic photosensitive member, charging means for charging the electrophotographic photosensitive member, developing means for supplying a developer to the electrophotographic photosensitive member and cleaning means for cleaning the electrophotographic photosensitive member. In particular, a process cartridge is a cartridge in which at least one of the charging means, the developing means and the cleaning means, and the electrophotographic photosensitive member are integrally made into the cartridge, and the cartridge is made detachably attachable to the main body of the electrophotographic image forming apparatus, or a cartridge in which at least the developing means and the electrophotographic photosensitive member are integrally made into the cartridge and the cartridge is detachably attachable to the main body of the electrophotographic image forming apparatus.

2. Related Background Art

Conventionally, in an image forming apparatus of an electrophotographic system such as an electrophotographic copier or a laser beam printer, an electrophotographic photosensitive member as an image bearing member is uniformly electrified by using charging means, and thereafter, the surface is irradiated with light corresponding to image information to form a latent image. Then, a developer is supplied to the latent image using developing means to visualize the latent image, and after the visualized image is transferred to a recording medium, the image is fixed in a fixing apparatus to obtain an image on the recording medium. Further, the electrophotographic photosensitive member after the transfer is cleaned with cleaning means.

In such an image forming apparatus, in order to attain simpleness and easiness of exchange and maintenance of expendable supplies such as the electrophotographic photosensitive member and the developer, there is a process-cartridge system in which an electrophotographic photosensitive member, developing means as process means acting on the electrophotographic photosensitive member, charging means, cleaning means, and further, a container for a developer and a container for a waste developer are integrally made into a process cartridge, and the cartridge is detachably attachable to the main body of the image forming apparatus.

According to the cartridge system, a user can conduct maintenance of the apparatus without a serviceman. Images can be formed again by exchanging a cartridge by the user when the developer has run out or when the photosensitive member drum has expired, for example. As described above, the cartridge system can remarkably improve operability of the apparatus, and thus, is widely used in the electrophotographic image forming apparatuses.

In the image forming apparatus of the cartridge system, for example, it is necessary that the user exchange the cartridge at an appropriate time by notifying the user that the expendable supplies such as the electrophotographic photosensitive member and the developer have expired or that they are approaching the end of their life.

Conventionally, as a method of detecting the life of an electrophotographic photosensitive member having, for example, a cylindrical shape, that is, a photosensitive member drum:

(1) there is a method of detecting the end of the life of a photosensitive member drum by integrating the number of sheets of image formation. In the simplest method, in the case where the size of the sheets of the recording medium, on which an image is formed, differs, for example, between A4 size and A3 size, the sheets of the recording medium are counted as the same. However, in this method, the precision of detecting the end of the life of the photosensitive member drum is not satisfactory. Further, with only integration of the number of sheets of image formation, the rotation time of the photosensitive member drum per one sheet of the recording medium differs depending on how many sheets are used for image formation per one job, that is, how many sheets of the recording medium are used for continuous image formation from the start of the image forming operation. Thus, the life of the photosensitive member drum varies in accordance with the rotation time, which is described later. Therefore, in this method, the precision of detecting the end of the life of the photosensitive member drum is not satisfactory.

Moreover, (2) as described in Japanese Patent Application Laid-open No. 4-51259 as prior art, there is a method of detecting a charge amount of a photosensitive drum with a surface potential sensor. In accordance with this method, in actuality, a reduction of charge potential of the photosensitive member drum or a reduction of latent image contrast can be directly detected with the surface potential sensor. Thus, in comparison with the method (1) described above, end of life detection with satisfactory precision is possible, which reflects the state of an output image. However, in order to implement the above method, the surface potential sensor, an electric circuit for processing the output, and the like are needed, and thus, the cost increases. Further, with respect to a longitudinal direction of the photosensitive member drum, only the information on the photosensitive member drum corresponding to the sensor position is data needed to make a decision. Thus, the detection ability to detect a partial defect is weak, and this method is plagued by the variations in the surface potential sensor and instability of change with time and the like. Therefore, this method is not necessarily a method of constantly detecting the end of the life of the photosensitive member drum with accuracy.

Furthermore, (3) as a method of improving detection accuracy of the end of the life of the photosensitive member drum while solving the problem of the above method (1), there is disclosed, in Japanese Patent Application Laid-open No. 5-188674, a method of integrating the rpm of the photosensitive member drum instead of integrating the number of sheets of image formation. Based on the same principle, there is a method of integrating the rotation time of the photosensitive member drum. In any of these methods, since, with respect to one image formation operation, as the size of the recording medium becomes larger, the rpm (rotation time) increases while as the size of the recording medium becomes smaller, the rpm (rotation time) decreases, in accordance with the size of the recording medium, and the detection error of the end of the life of the photosensitive member drum due to the size difference of the recording medium becomes smaller in comparison with the case of integrating the number of sheets on which image formation occurs. Further, the rpm (rotation time) of the photosensitive member drum is directly integrated irrespective of the number of sheets used for image formation per one job, and thus, the precision of the end of life detection is relatively satisfactory.

As a method which is developed on the basis of the above method (3), there is disclosed, in Japanese Patent Application Laid-open No. 4-98265, a method in which the rpm of the photosensitive member drum at the time of actual image formation is integrated by integrating the rpm of the photosensitive member drum only at the time when a transfer charger as transferring means operates so that the life detection of the photosensitive member drum with more accuracy is possible. Further, there is disclosed, in Japanese Patent Application Laid-open No. 6-180518, a method in which the rpm of the photosensitive member drum during an electrification process of the photosensitive member drum, and the rpm of the photosensitive member drum while a cleaning member that cleans the photosensitive member drum contacts, are respectively integrated, and the end of the life of the photosensitive member drum is determined on the basis of comparison of the respective rpms and the setting values (life).

Further, the following method is known as a method of notifying a user of the proper timing for a process-cartridge exchange. Namely, in a method disclosed in Japanese Patent Application Laid-open No. 5-333626, the timing for the an exchange of a process cartridge structured with a cleaner (cleaning means) and an electrophotographic photosensitive member is firstly notified to the user on the basis of the end of the life of the electrophotographic photosensitive member. That is, the apparatus is stopped at the time when the electrophotographic photosensitive member reaches the end of its guaranteed life by integrating the number of sheets used for image formation and becomes unusable. Besides, as an exchange-display operation based on the end of the life of the electrophotographic photosensitive body, the apparatus urges a user to prepare a cartridge for exchange by displaying an indication that the exchange time is approaching the guaranteed life of the cartridge, or in a case where the cartridge is continuously used, the apparatus warns that the time to stop the use of the apparatus is approaching. Further, in accordance with this conventional technique, the apparatus is structured such that the user is notified of the time for a cartridge exchange also based on the toner capacity of a recovered toner containing portion of the cleaner. That is, the on-time of a driving motor for toner replenishment is integrated, and the apparatus is stopped in accordance with the integration time which is expected to come the earliest under the worst condition in which various variations are considered. Also in this case, as the exchange-display operation based on the capacity in the toner containing portion, the display to prompt the user to exchange a cartridge at the time when the integration time of the on-time of the driving motor for toner replenishment becomes a certain value is made, and the display to notify the user that the time to stop the apparatus is approaching is made at a later integration time.

In this conventional technique, the operation based on the life of the electrophotographic photosensitive member and the operation based on the toner capacity in the recovered toner containing portion of the cleaner are generally set so as to have priority over the number of prints, that is, the life of the electrophotographic photosensitive member. However, when toner replenishment is frequently conducted because of an unusual high image density, and the recovered toner container is about to be filled earlier compared with the guaranteed life of (the guaranteed number of sheets of) the electrophotographic photosensitive member, an action is taken based on the toner capacity of the recovered toner container.

Here, in the technique disclosed in Japanese Patent Application Laid-open No. 5-333626, the process cartridge is provided with storage means, the total electrification time of a primary electrifier provided in the image forming apparatus is collectively written in the storage means through a CPU provided in the image forming apparatus at the time of the exchange of the process cartridge, and also, the subsequent electrification time of the primary electrifier is written and stored in the storage means. Then, the storage means of the spent process cartridge is collected and analyzed, whereby the rpm of the photosensitive member drum at present, and the total amount of discharge time of corotron and the like of the image forming apparatus in which the spent process cartridge has been used can be known with accuracy, and information collection to the image forming apparatus can be conducted at intervals of the exchange of the process cartridge. The above is disclosed. More specifically, the operation-cycle number of the photosensitive member drum, the exchange time of an ozone filter, the abrasion (or wear) prediction data of the photosensitive member drum, and the like of the image forming apparatus at the time of the exchange of the process cartridge can be known.

However, the determination of the expiration date of the photosensitive member drum in the technique disclosed in this application is based on the number of sheets of image formation in the end. As described above, there is no change in the point in that the precision of the prediction of the end of life of the photosensitive member drum based on the number of sheets of image formation is not satisfactory.

On the other hand, in recent years, as a developing apparatus for developing a latent image formed on an electrophotographic photosensitive member, there is a apparatus in which so-called one-component developer, which substantially contains toner as its only constituent, is used. In this developing apparatus of a one-component developing system, a mixture of toner and a carrier, agitation, and control of the toner density (the ratio of the toner to the total amount of the toner and the carrier) are not necessary, which is dissimilar to a so-called developing apparatus of a two-component developing system. Thus, miniaturization of the apparatus and low cost can be realized, and also, exchange of the developer becomes unnecessary, which is very effective in a printer or the like desired to be maintenance-free. If non-magnetic toner is used as the toner for the one component developer, it becomes unnecessary to provide a developer carrying member for carrying a developer to an electrophotographic photosensitive member with a magnet roll. Thus, the miniaturization of the apparatus and the low cost can be further realized.

As the developing apparatus of a one-component developing system, there is known a so-called developing apparatus of a contact-one-component developing system comprising: a developer container (hopper) for containing one-component developer (toner); a developer carrying member (developing roller) having a roller shape or the like for carrying toner to a latent image on an electrophotographic photosensitive member, which is provided adjacent to the developer container; a toner supply roller rotating in the same direction as the developing roller while contacting the developing roller; and developer-layer-thickness regulating means (regulating blade) having a blade shape or the like for regulating the toner amount carried on the developing roller, in which the toner in the hopper is carried to the developing roller by the toner supply roller, a toner thin layer is formed on the developing roller by the regulating blade, and the toner thin layer is made to contact the electrophotographic photosensitive member, to thereby develop the electrostatic latent image formed on the electrophotographic photosensitive member.

In a case where the non-magnetic toner is used as the toner for the one component developer, the regulating blade, which is an elastic blade or the like, is made to be in contact with the developing roller, the Coulomb force, due to the charge of the toner or triboelectrification is utilized to form the toner thin layer on the developing roller, and thus, supplying and carrying of the toner are conducted.

Further, in recent years, a contact electrifier is widely being used instead of a corona electrifier, which has been conventionally and widely used as an electrifier for performing an electrification process with an electrophotographic photosensitive member. The contact electrifier has many merits including a lower applied bias that is sufficient for the contact electrifier compared with the corona electrifier, the generation of a very small amount of ozone, a small number of required components that structure the electrifier, and a low cost for providing the electrifier.

Such a contact electrifier is roughly divided into a brush electrifier and a roller electrifier in accordance with the shape of a charging member to be used. The brush electrifier has problems involving a track of the brush, a bend of the brush in a case where the electrifier is made to be in contact with the electrophotographic photosensitive member for a long period of time, and the like. On the other hand, the roller electrifier has difficult problems in that resistance regulation of the roller is necessary in order to obtain uniform electrification, in that contamination of the drum has to be prevented, which arises from bleed from rubber that constitutes the roller, and in that there is a strict limitation on the shape, the surface property and the like, of the roller in order to obtain uniform electrification.

As the voltage applied to the contact charging member, only a DC bias (hereafter, referred to as "DC electrification") and an AC bias superposed on a DC bias (hereafter, referred to as "AC electrification") are given. Generally, there is a feature that the AC electrification enables uniform electrification compared with the DC electrification.

Examples of AC electrification include an electrification process in which a charging member having a roller shape (charging roller) is used as a charging member, and a DC voltage is superposed on an AC voltage which is twice or more as large as the voltage at the start of discharge of an applied bias (Japanese Patent Application Laid-open No. 63-149669 and Japanese Patent Application Laid-open No. 1-267667), and an electrification process in which a conductive brush is used as an electrification member, and a DC voltage is superposed on an AC voltage which is twice or less as large as the voltage at the start of discharge of an applied bias (Japanese Patent Application Laid-open No. 6-130732).

The contact-electrification system described above has the merits that a small amount of ozone is generated, that the number of the required components that structure the electrifier are small, and that the electrifier is provided at a low cost. However, the damage to the electrophotographic photosensitive member is larger compared with corona electrification. In particular, this tendency is conspicuous in case of using an OPC photosensitive member drum.

Further, even in the same contact electrification method, the damage to the electrophotographic photosensitive member varies according to the applied voltage to the charging member, and as the applied voltage increases, the damage to the electrophotographic photosensitive member becomes larger. In the case that only the DC voltage is applied as an electrification bias, the damage increases in comparison with the case where the photosensitive member drum is rotated without applying the electrification bias. Moreover, it is found out that the damage (particularly, the abrasion amount of the OPC photosensitive member drum) further increases, and the damage is about several times as large as the damage in a case where only the DC voltage is applied as the electrification bias when the AC voltage superposed on the DC voltage is applied as the electrification bias.

In particular, if the AC voltage, which is twice or more as large as the voltage at the start of discharge, is applied, the phenomenon of damage to the electrophotographic photosensitive member becomes conspicuous. However, even if the AC voltage, which is twice or less as large as the voltage at the start of discharge, is applied, the damage is about several times as large as the damage in the case where only the DC voltage is applied.

Further, also in a case where the frequency of the AC voltage applied as the electrification bias is made larger, there is a tendency that the damage to the electrophotographic photosensitive member (in particular, the OPC photosensitive member drum) increases.

On the other hand, as described above, in recent years, there has been used a method in which a developing roller as a developer carrying member is made to carry one component developer, and the developing roller is made to be in contact with a photosensitive member drum to develop an electrostatic latent image on the photosensitive member drum, but the photosensitive member drum is scraped by contact rotation of the developing roller as well.

In general, in a case where a one component non-magnetic developing apparatus is used, in which a developing roller contacts a photosensitive member drum, the peripheral speed of the developing roller is increased with respect to, for example, the peripheral speed of the photosensitive member drum in order to secure the required density. Particularly, in a case where the developing roller has a relative peripheral speed ratio with respect to the photosensitive member drum, there is a tendency that the damage to the photosensitive member drum increases.

However, in a color image forming apparatus in which an electrostatic latent image on a photosensitive member drum is developed by switching developing apparatuses of a plurality of colors, and in an image forming apparatus in which a spacing mechanism is provided for having a clearance between a developing roller and a photosensitive member drum, and a method of having a clearance between the developing apparatus and the photosensitive member drum at the rotation of the photosensitive member drum during a non-image formation period is adopted in order to prevent the fog of contact development, the rotation time of the photosensitive member drum is not proportional to the contact time of the photosensitive member drum and the developing roller.

As apparent from the above description, in an image forming apparatus that is provided with the charging means that electrifies the photosensitive member drum with, for example, contact electrification under a plurality of electrification conditions during image formation and in which both the AC voltage and the DC voltage are used, the damage that the photosensitive member drum receives varies according to the electrification condition. Thus, with the conventional method of detecting the end of the life of the photosensitive member drum on the basis of only the rpm of the photosensitive member drum, it is difficult to predict the life of the photosensitive member drum with accuracy.

Further, in a case where a developing apparatus that can be alienated from the photosensitive member drum is used, the rotation time of the photosensitive member drum is not proportional to the contact time of the photosensitive member drum and the developing roller as described above. Thus, in the conventional method of detecting the end of the life of the photosensitive member drum on the basis of only the rpm of the photosensitive member drum, it is impossible to predict the end of the life of the photosensitive member drum with accuracy.

Due to the above reasons, there is a fear that inconvenience occurs such that a warning for a cartridge exchange is not issued although the photosensitive member drum has expired, thereby generating an image defect or such that the warning for a cartridge exchange is issued although the photosensitive member drum has not actually expired yet.

SUMMARY OF THE INVENTION

Accordingly, a main object of the present invention is to provide a method of detecting the end of the life of an image bearing member in which the end of the image bearing member's life or the approaching of the end of the member's life can be detected with accuracy, an image forming apparatus, and further, a cartridge detachably attachable to the image forming apparatus.

Another object of the present invention is to provide a method of detecting the end of the life of an image bearing member in which the user can be accurately notified of the exchange time based on the life of the image bearing member and or the approaching exchange time, an image forming apparatus, and further, a cartridge detachably attachable to the image forming apparatus.

Still another object of the present invention is, particularly, to provide a method of detecting the end of life of an image bearing member in which it can be accurately detected that the image bearing member has reached the end of life or is approaching the end of life in a case where the image bearing member is electrified under a plurality of electrification conditions and developing means can be alienated from the image bearing member, an image forming apparatus using the method, and further, a cartridge detachably attachable to the image forming apparatus.

BRIEF DESCRIPTION OF THE DRAWINGS

FIG. 5 is a flow chart showing one embodiment of the detection of the end of the life of a photosensitive member in accordance with the present invention;

FIG. 6 is a flow chart of another embodiment of detection of the life of a photosensitive member in accordance with the present invention;

FIG. 8 is a flow chart of still another embodiment of the detection of the life of a photosensitive member in accordance with the present invention.

DETAILED DESCRIPTION OF THE PREFERRED EMBODIMENTS

Hereinafter, a method of detecting the end of the life of an image bearing member, an image forming apparatus, and a cartridge according to the present invention are explained in detail with reference to the accompanying drawings.

Embodiment 1

Figure 1:
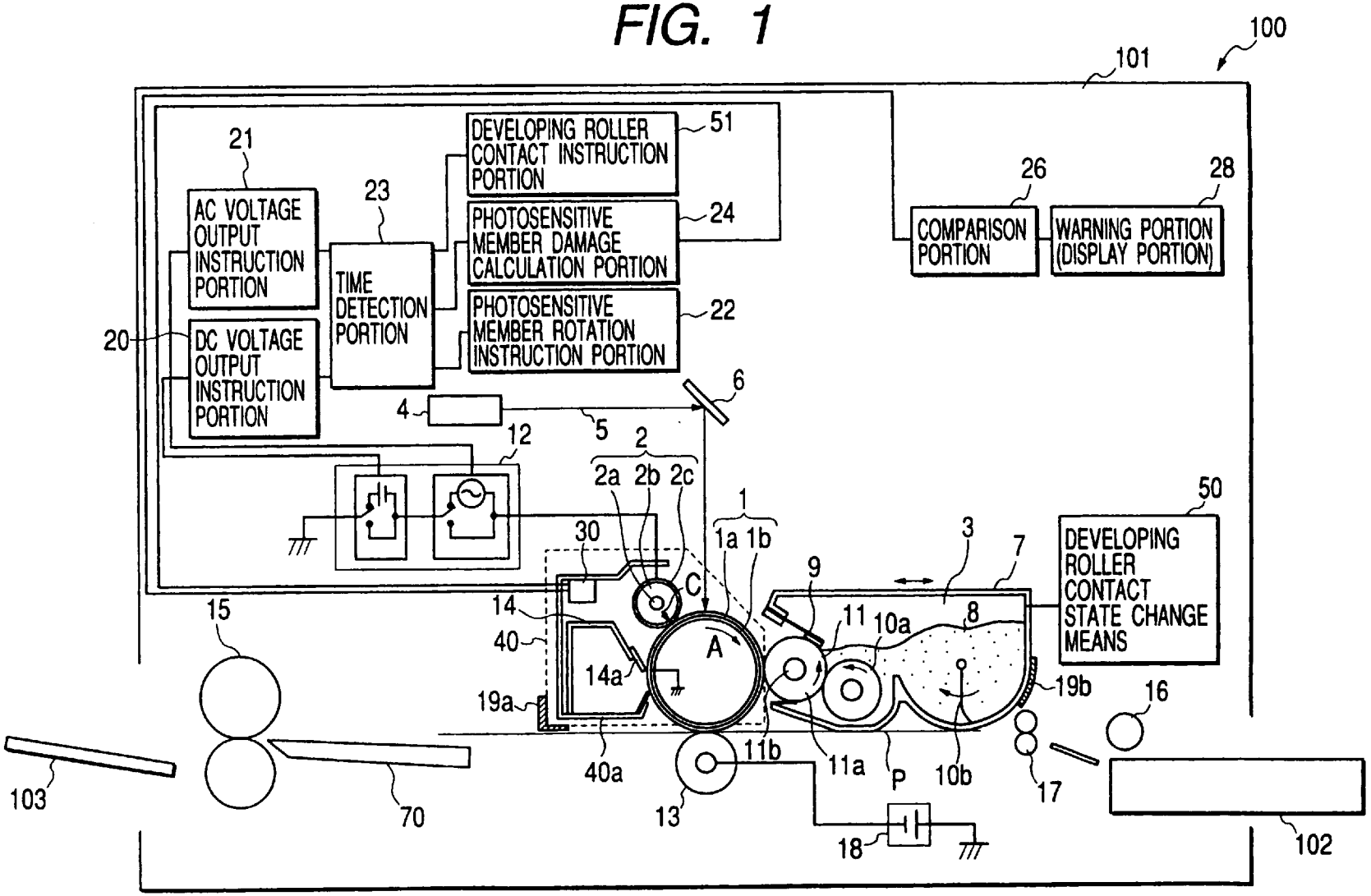
FIG. 1 is a schematic structural diagram showing one embodiment of an image forming apparatus according to the present invention.
Figure 2:
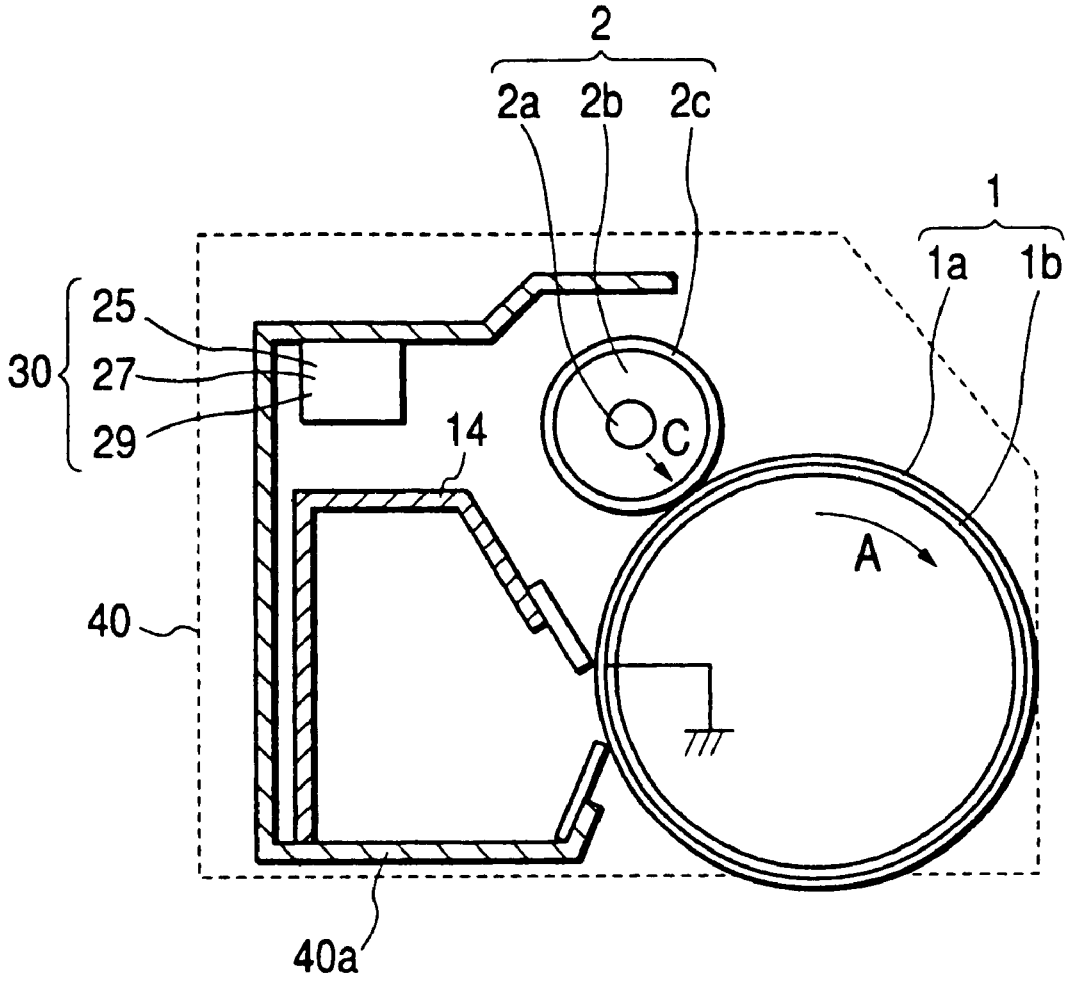
FIG. 2 is a schematic structural diagram showing one embodiment of a cartridge detachably attachable to the image forming apparatus of the present invention.

One embodiment of the image forming apparatus of the present invention is described with reference to FIGS. 1 and 2. FIG. 1 shows a schematic construction of the image forming apparatus of this embodiment. In this embodiment, the image forming apparatus is a printer of an electrophotographic system and particularly, a laser beam printer (LBP) 100 that performs exposure using laser light.

The printer 100 in this embodiment has a cylindrical electrophotographic photosensitive member (photosensitive member), that is, a photosensitive member drum 1 as an image bearing member as shown in FIG. 1. The photosensitive member drum 1 has an outer diameter of 30 mm, is structured by laminating a light conductive photosensitive layer 1*a* on a surface of a conductive base 1*b* made of aluminum, and is rotatingly driven with a peripheral speed of 100 mm/sec in an arrow A direction in the figure. In this embodiment, the photosensitive member drum 1 is an OPC photosensitive member drum having the photosensitive layer 1*a* with a polycarbonate resin as a main binder.

The photosensitive member drum 1 receives negative polar uniform electrification (primary electrification) by a charging roller 2 as a charging means. Subsequently, laser exposure 5 is output with a resolution of 600 dpi from a laser scanner 4 provided as an optical system in accordance with a time-series electric digital image signal of image information sent from a video controller (not shown), and scanning exposure is performed on the photosensitive member drum 1 through a mirror 6. Thus, an electrostatic latent image is formed on the surface of the photosensitive member drum 1.

Reversal-developing is conducted on the electrostatic latent image on the photosensitive member drum 1 by a developer 8 carried on a developing roller 11 as a developer carrying member provided in a developing apparatus 7 as developing means, and the electrostatic latent image is visualized as a toner image.

On the other hand, a recording medium P is sent to the inside of an apparatus main body 101 from a recording medium cassette 102 as a recording medium receiving means by a feed roller 16 or the like, and is conveyed to a registration roller 17. The registration roller 17 sends the recording medium P to a transferring portion where the photosensitive member drum 1 and a transfer roller 13 as a transferring means are opposite to each other in synchronization with the formation of the toner image on the photosensitive member drum 1.

The toner image formed on the photosensitive member drum 1 is electrostatically transferred on the recording medium P by the transfer roller 13. Then, the recording medium P subjected to the transfer of the toner image is separated from the photosensitive member drum 1 to be introduced into a fixing apparatus 15 through a conveying means 70. After the toner image is fixed on the recording medium P, the recording medium P is discharged from the image forming apparatus main body 101, and is mounted on a discharge tray 103. The developer, which has not been transferred, and which is called waste toner, remaining on the photosensitive member drum 1 after the transfer process, is cleaned at a cleaning device 14, and the photosensitive member drum 1 is subjected to the electrification process again. In this embodiment, the cleaning device 14 is provided with a blade cleaning member 14*a* as a cleaning means for scraping the waste toner by contacting the photosensitive member drum 1.

In this embodiment, the photosensitive member drum 1, the charging roller 2 and the cleaning device 14 are integrated by a casing (container) 40*a*, which is made as a drum unit (process cartridge) 40 detachably attachable to the apparatus main body 101. Further, the developing apparatus 7 is a developing unit detachably attachable to the apparatus main body 101 as another unit. The drum unit 40 and the developing unit are detachably and attachably supported by the apparatus main body 101 through mounting means 19*a*, 19*b*, respectively.

A storage element 30 as a storage means is mounted in the drum unit 40. Further, the container 40*a* of the drum unit 40 is provided with a connection terminal (not shown) in order to be able to communicate with a control portion of the apparatus main body 101 when the image forming apparatus is equipped with the drum unit 40, and reading-out and writing-in of information to the storage element 30 are possible.

As the storage means, an electronic memory (storage element) formed of a general semiconductor such as a non-volatile memory or a combination of a volatile memory and a backup battery can be used without special limitation.

The developing apparatus (developing unit) 7 is further explained here. The developing apparatus 7 used in this embodiment adopts a contact developing system, and includes: the developing roller 11 as a developer carrying member which is rotatably supported and carries the developer 8 to the photosensitive member drum 1; a supply roller 10*a* for applying the developer 8 by rotating in a counter direction while contacting the developing roller 11; a developer containing chamber 3; and an agitating means 10*b* for agitating and carrying the developer and supplying the developer 8 in the direction of the supply roller 10*a*. The developing apparatus 7 is supported by the apparatus main body 101 such that the developing roller 11 is alienatably contactible with the photosensitive member drum 1, and the state of the developing roller 11 being in contact with or having a clearance with the photosensitive member drum 1 is changed by a contact-state change means 50.

Figure 3A:
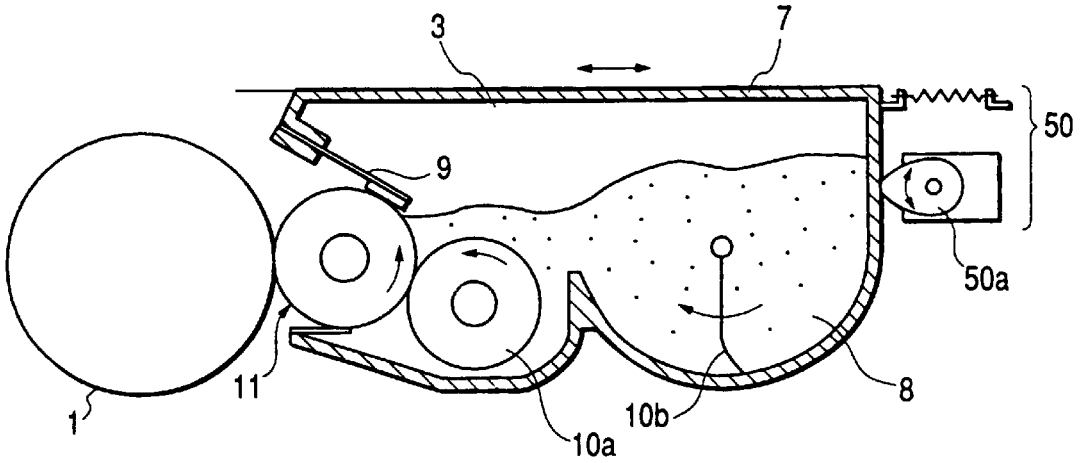
FIGS. 3A and 3B are schematic structural diagrams showing one embodiment of contact state change means of developing means.
Figure 3B:
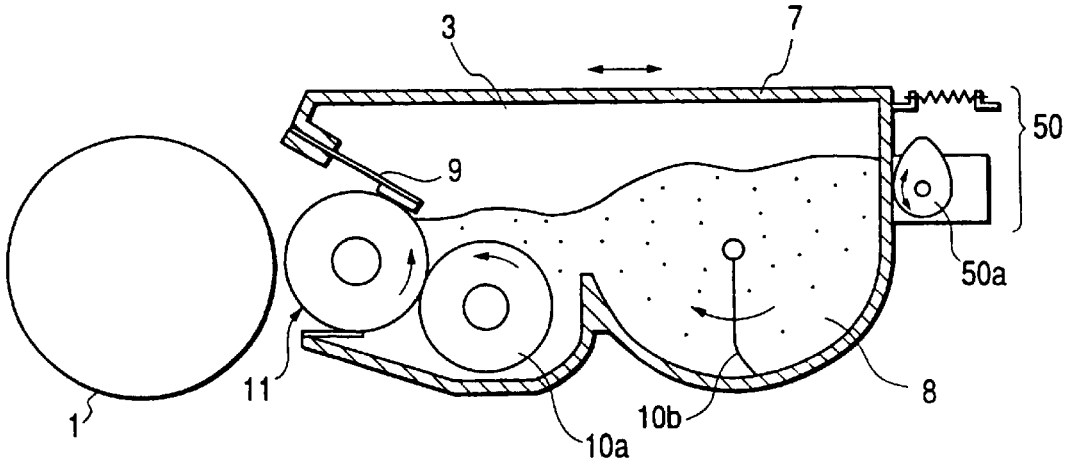

FIGS. 3A and 3B show an example of the contact-state change means 50 of the developing roller 11. The contact-state change means 50 of this embodiment has a cam member 50*a* contacting a part of the developing apparatus 7. The developing apparatus 7 slides in a horizontal direction by the rotation of the cam member 50*a* to change the state of the developing roller 11 being in contact with or having a clearance with the photosensitive member drum 1. FIG. 3A shows the state of the developing roller 11 being in contact with the photosensitive member drum 1 and FIG. 3B shows the state of the developing roller 11 having a clearance with the photosensitive member drum 1.

The developing roller 11 has a structure in which a cored bar 11*b* is provided with a conductive elastic layer 11*a*, and is generally driven with a peripheral speed ratio of 100 to 200% (the speed at a peripheral speed ratio of 100% is the same as the speed of the photosensitive member drum 1) with respect to the photosensitive member drum 1 in accordance with a developing property of the developer. When the applied bias of −500 V is supplied, a thin layer of the developer 8 applied on the developing roller 11 by an elastic blade 9 as a developer-layer thickness regulating member is transferred to the electrostatic latent image on the photosensitive member drum 1 in the opposing portion of the photosensitive member drum 1.

In this embodiment, non-magnetic one component toner (toner) is used as the developing toner 8, and the developer toner 8 is received in the developer containing chamber 3.

Further, the charging roller 2 as the contact charging means is further explained. The charging roller 2 has a two-layer structure in which a sponge layer 2*b* and a surface 2*c* are wound around a cored bar 2*a* (sponge charging roller). The cored bar 2*a* has a diameter of 6 mm, the outer diameter of the roller is 12 mm, and the roller length is about 220 mm. Further, both ends of the cored bar 2*a* in the longitudinal direction are pressurized with 500 gf (≅4.9N) in an arrow c direction in the figure, and the charging roller 2 contacts the photosensitive member drum 1 with a nip of approximately 1.5 mm. The charging roller 2 is driven and structured so as to followingly rotate with respect to the photosensitive member drum 1.

The charging roller 2 is connected with a charging bias applied source 12 through the cored bar 2*a*. In this embodiment, as shown in the sequence of the image forming operation of FIG. 4, in a part of the photosensitive member drum 1 during the rotation including an image forming region, a bias in which a DC bias of −700 V is superposed on an AC bias (peak to peak voltage of 1600 V, frequency of 1000 Hz, and sine wave) is applied as a charging bias applying condition 1, and the surface of the photosensitive member drum 1 is uniformly charged at about −680 V (AC charge). Further, as to other portions of the photosensitive member drum 1 during the rotation, there exist a portion in which only a DC bias of −1250 V is applied as a charging bias applying condition 2, and the surface of the photosensitive member drum 1 is charged at about −680 V (DC charge) and a portion not applied with a charging bias as a charging bias applying condition 3.

In this embodiment, the charging bias applying condition is changed in accordance with the following purposes.

Charging bias applying condition 1 (AC charge): In order to obtain a uniform and satisfactory image in an image region, and also, in order to remove the surface potential at the end of image formation, a DC bias superposed on an AC bias is used.

Charging bias applying condition 2 (DC charge): Although a uniform surface potential is not particularly required, a constant surface potential for prevention of an unnecessary spout of the developer from the developing apparatus 7, that is, an unnecessary developing operation and for cleaning of the transfer roller 13 is required. Thus, only a DC bias, which causes a small amount of damage to the photosensitive member drum 1, is used.

Charging bias applying condition 3: Since a constant surface potential is not particularly required, a charging bias is not applied.

It is to be noted that, with the same purpose as for the charging bias applying condition 2, a method of lowering a voltage value (or a current value) of the AC bias, a method of lowering frequency, and the like can be used, and the methods are also effective.

Next, a method of detecting the end of the life of the photosensitive member drum 1 is explained as a method of detecting the end of the life of an image bearing member that is characteristic of the present invention.

As shown in FIG. 1, the rotating operation of the photosensitive member drum 1 is controlled by a photosensitive-member-rotation-instruction portion 22. The charging roller 2 as the contact charging member is appropriately applied with an AC bias and a DC bias, which are independently controlled by an AC voltage output-instruction portion 21 and a DC voltage output-instruction portion 20, respectively, by the charging bias applied source 12.

Further, the contact-state change means 50 is controlled by a developing-roller-contact-instruction portion 51, and change the movement of the developing apparatus 7, that is, the state of the developing roller 11 being in contact with or having a clearance with the photosensitive member drum 1.

The AC voltage output-instruction portion 21, the DC voltage output-instruction portion 20 and the photosensitive-member-rotation-instruction portion 22 are coupled with a time-detection portion 23 as a time-detection means, and applied times t1, t2 and t3 described later are detected under the respective charging-bias applying conditions during one job of the image forming operation. Further, the developing-roller-contact-instruction portion 51 is coupled with the time-detection portion 23, and the time when the developing roller 11 contacts the photosensitive-member drum 1 (developing roller contact time) td during one job of the image forming operation is detected.

Figure 4:
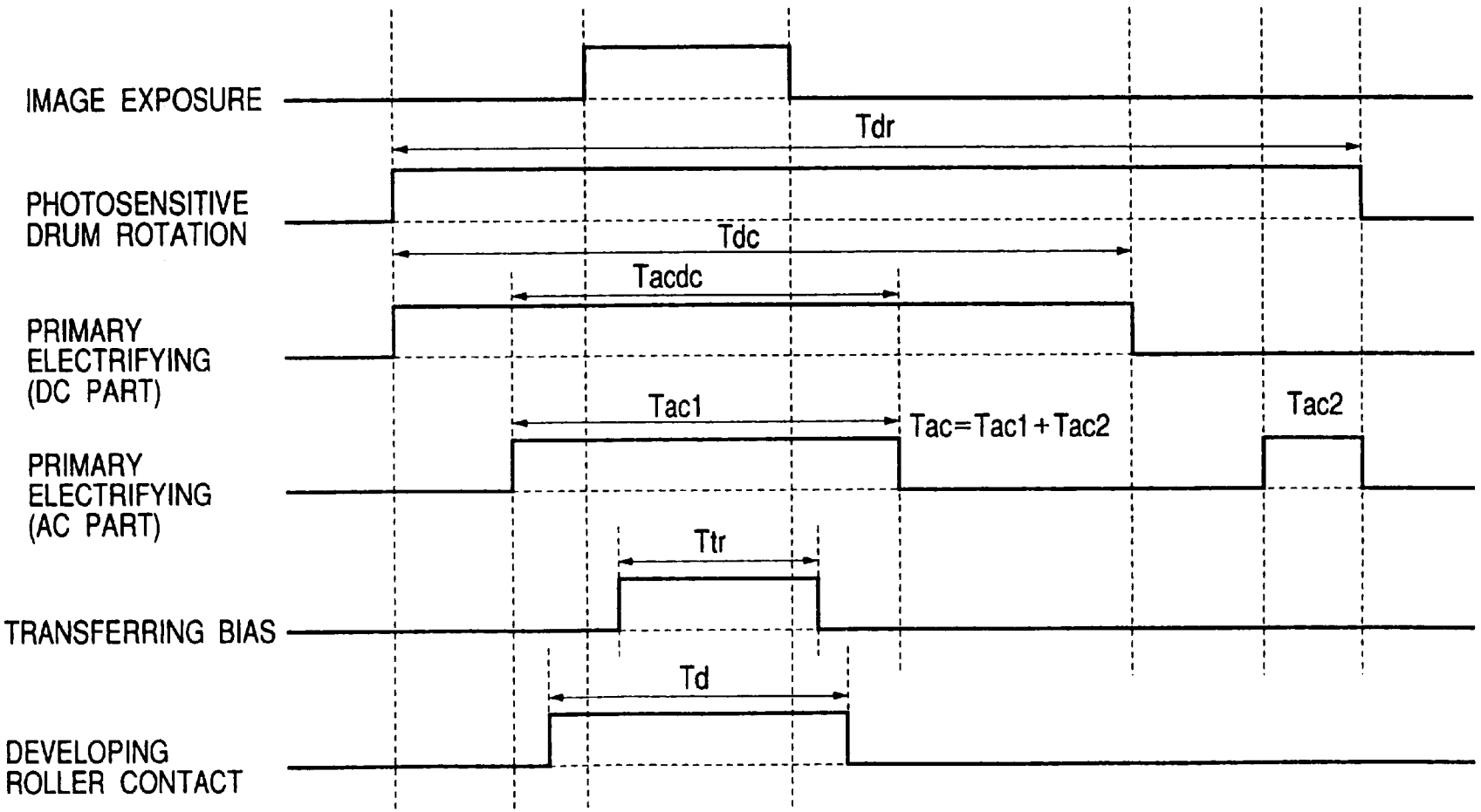
FIG. 4 is a timing chart showing one example of an image forming operation of the image forming apparatus that can preferably implement the present invention.
Figure 7:
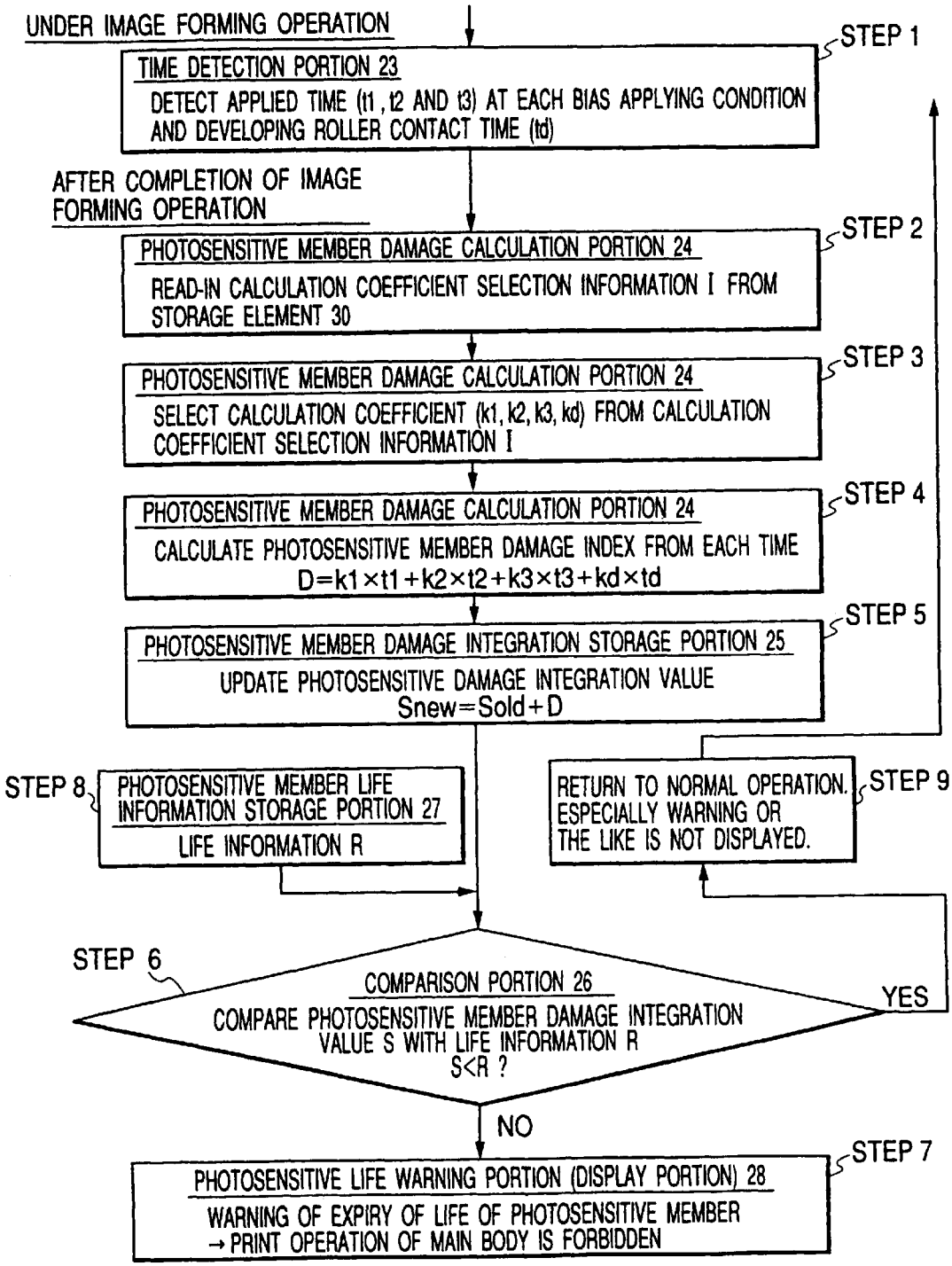
FIG. 7 is a flow chart of still another embodiment of the detection of the end of the life of a photosensitive member in accordance with the present invention.

Here, as shown in the sequence of the image forming operation of FIG. 4, t1 corresponds to applied time information Tac (t1=Tac=Tac1+Tac2) from the AC voltage output-instruction portion 21, t2 corresponds to what is obtained by subtracting time Tacdc when the AC voltage is superposed from applied time information Tdc from the DC voltage output-instruction portion 20 (t2=Tdc−Tacdc), and t3 corresponds to what is obtained by subtracting t1 and t2 from photosensitive-member-rotation-time information Tdr from the photosensitive-member-rotation-instruction portion 22 (t3=Tdr−(t1+t2)), that is, the time when the photosensitive member drum 1 rotates with the charging bias being off or of 0 V.

The procedure of detecting the end of the life of the photosensitive member drum 1 is explained with reference to a flow chart of one embodiment of the method of detecting life of the photosensitive member drum 1 shown in FIG. 5. First, during one job of the image forming operation, the applied times t1, t2 and t3 under the respective charging bias applying conditions and the time td when the developing roller 11 contacts the photosensitive member drum 1 are detected in the time-detection portion 23 (step S1).

After the completion of one job of the image forming operation, the applied times t1, t2 and t3 under the respective charging-bias applying conditions, the developing-roller contact time td, and photosensitive-member-damage-calculation coefficients k1, k2, k3 and kd contained in a photosensitive-member-damage-calculation coefficient storage portion 29 in the storage means 30 of the drum unit 40 are delivered to a photosensitive-member-damage-calculation portion 24 as an image-bearing-member-damage-calculation means (step S2). The photosensitive-member-damage-calculation portion 24 is coupled with the storage means 30 in the drum unit 40 in such a state that the apparatus main body 101 is mounted with the drum unit 40.

Next, a photosensitive member damage index D which is a parameter relative to the photosensitive member damage is calculated by the following formula (1) (step S3):

$$D=k1\times t1+k2\times t2+k3\times t3+kd\times td \quad (1)$$

(In this embodiment, the respective coefficient in the above formula are k1=1, k2=0.3, k3=0.1, and kd=0.3.)

The photosensitive-member-damage-calculation portion 24 reads a photosensitive-member-damage-integration value S stored in a photosensitive-member-damage-integration storage portion 25 of the storage means 30 every one job of the image forming operation, and adds a photosensitive-member damage index D during one job to the photosensitive-member damage integration value S to update the photosensitive-member-damage-integration value S as image-bearing-member-damage-integration means (Snew=Sold+D) (step S4). This operation is repeated for every one job of the image forming operation.

After the completion of one job of the image forming operation and then, the completion of the update of the integration value S stored in the storage means 30 of the drum unit 40, a comparison portion 26 as a comparison means reads life information R set in advance from a photosensitive-member-life-information-storage portion 27 of the storage means 30 of the drum unit 40 (step S7), and reads the updated integration value S from the photosensitive-member-damage-integration-storage portion 25 of the storage means 30 and compares the relationship in size with the updated photosensitive-member-damage-integration value S (step S5).

Based on the result of the comparison in the step S5, in a case where the updated integration value S is equal to or more than the life information R (S≧R), for example, an information transmitting means served by the comparison portion 26 sends a signal to a photosensitive-member-life-warning portion (display portion) 28 as a notifying means provided in the apparatus main body 101 in this embodiment, warns the user or displays a message that the photosensitive member drum 1 has reached the end of its life, and forbids the image forming operation (step S6).

As to the determination at the step S5, in a case where the photosensitive-member-damage-integration value S is smaller than the life information R (S<R), the warning and the display are not particularly made, and the operation returns to the normal operation (step S8).

The damage to the photosensitive member drum 1 is further explained. As shown in the sequence of FIG. 4, the rotation time of the photosensitive member drum 1 (Tdr), the DC bias applied time (Tdc), the AC bias applied time (Tac), and the developing-roller contact time (Td) are different from each other.

The present inventors examined the damage to the photosensitive member drum 1 in each state in the sequence of the image forming operation, in particular, abrasion of the photosensitive member drum 1 (drum abrasion). As a result, in a case where the drum abrasion in the state that bias is not applied is 1 in the state that the developing roller 11 contacts the photosensitive member drum 1, the drum abrasion in the state that a DC bias is applied is 2 to 3, the drum abrasion in the state that an AC bias is further applied is 8 to 10, and the drum abrasion in the state that a DC bias and an AC bias are applied while the developing roller 11 alienates the photosensitive member drum 1 is 6 to 8, which shows a large difference. This result was obtained by the examination with the system such that the OPC photosensitive member with a surface layer whose main binder is a polycarbonate resin is used as the photosensitive member and the blade cleaning member is used as the cleaning means of the photosensitive member.

In accordance with the above result, when it is considered that, in general, the life of the photosensitive member drum 1 is determined dominantly by drum abrasion, the applied times of the respective charging-bias applying conditions are multiplied by predetermined coefficients, respectively, and the obtained results are summed up in the case that there are a plurality of the charging-bias applying conditions. Thus, the drum-abrasion amount by the application of the charging bias is estimated, and the life of the photosensitive member drum 1 can be judged.

Further, as is apparent from the above examination, the drum-abrasion amount differs in the respective states of the developing roller 11 such as it is in contact with or having a clearance with the photosensitive member drum 1. The drum-abrasion amount is larger in a case where the developing roller 11 contacts the photosensitive-member drum 1. Therefore, in a case where the state of the developing roller 11 being in contact with or having a clearance with the photosensitive member drum 1 is changed, the time when the developing roller 11 contacts the photosensitive member drum 1 is multiplied by a predetermined coefficient to estimate the drum-abrasion amount by the contact of the developing roller 11. Thus, the life of the photosensitive member drum 1 can be judged.

That is, a general formula $$D = \sum_{i=1}^{n} (ki \times ti) + (kd \times td)$$

(k1>0, ki (i=2 to n)≧0, kd≧0) is used for the calculation of the photosensitive-member-damage index D, the index D is integrated to obtain the photosensitive-member-damage-integration value S, and the drum-abrasion amount is estimated. Thus, life detection with precision becomes possible.

In this embodiment, as described above, the applied times t1, t2 and t3 under the respective charging-bias applying conditions during one job of the image forming operation and the developing-roller contact time td are detected by the time-detection portion 23, the photosensitive-member-damage index D is calculated using the formula (1) based on the above general formula and the respective coefficients set in advance with respect to the image forming apparatus of this embodiment (photosensitive member damage calculation coefficient) (k1, k2, k3, kd) by the photosensitive-member-damage-calculation portion 24, and the photosensitive-member-damage-integration value S is updated by the latest integration value. Thus, the abrasion amount of the photosensitive member drum 1 is estimated, and therefore, the end of the life detection of the photosensitive member drum 1 with accuracy becomes possible.

In accordance with this embodiment, since the photosensitive-member-damage-integration value S stored in each drum unit differs by providing the storage means 30 in the drum unit 40, discrimination of the drum unit is easily conducted. That is, at the exchange for the new drum unit, even if a user mounts the old drum unit by mistake, the respective drum units can be discriminated without particularly providing a discriminating means. Thus, an exchange error of the user can be prevented, and the defect such that the drum unit over the end of life is mistakenly used to output a defect image can be prevented.

Further, by previously storing the life information R of the photosensitive drum in the storage means 30 of the drum unit 40, the end of the life of the drum unit can be appropriately detected and a warning can be provided in accordance with the set life of each drum unit even in a case where the drum unit with a different set life is mounted.

Moreover, the photosensitive-member-damage-calculation coefficients k1, k2, k3, and kd can be changed in accordance with the respective photosensitive-member drums, or lots of the photosensitive-member drums, and thus, the more appropriate life detection in accordance with the variation of the characteristic of the photosensitive member material, and the like becomes possible.

Note that, in this embodiment, the sponge charging roller 2 is used as the contact charging member, but a solid rubber roller may be used. Further, the contact charging member is not limited to a roller shape, and a blade shape, a brush shape, a brush roller and the like may be adopted.

Besides, in a case where the abrasion of the photosensitive-member drum 1 is not largely influenced in the sequence of the image forming operation, that is, in a case where the calculation coefficient ki is remarkably small with respect to k1 or in a case where the applied time ti is remarkably small with respect to t1, the item of the bias applying condition may be omitted to the extent that the required precision is not dropped.

Furthermore, in this embodiment, it is explained that the photosensitive-member-damage-calculation coefficients k1, k2, k3, and kd stored in the storage means 30 for every one job of the image formation are input in the photosensitive-member-damage-calculation portion 24. However, the input may be performed one time when the power source of the apparatus main body 101 is turned ON.

In accordance with this embodiment, the life of the photosensitive member drum 1, that is, the end of life of the electrophotographic photosensitive member can be accurately detected, and the exchange time based on the life of the photosensitive member drum 1 can be notified with accuracy. Therefore, since a satisfactory photosensitive-member drum 1 may always be used, a satisfactory image may always be obtained.

Embodiment 2

Another embodiment of the present invention is explained below. An image forming apparatus of this embodiment has basically the same structure as the image forming apparatus of Embodiment 1 shown in FIG. 1. Therefore, the elements with the same functions and structures have the same reference numerals, and a detailed description thereof is omitted.

A method of detecting the end of life of the photosensitive member drum 1 in this embodiment is explained with reference to a flow chart of FIG. 6. Steps 1 to 4 in FIG. 6 are the same as those in Embodiment 1 of FIG. 5, and therefore a description thereof is omitted.

In this embodiment, information for determining the life of the photosensitive-member drum 1 is set in 2 levels. That is, in this embodiment, the photosensitive-member-life-information-storage portion 27 provided in the storage means 30 in the drum unit 40 is set in two levels of warning information Y for instructing a user to prepare exchange, and real-photosensitive-member life information R at the time when the photosensitive member drum 1 has come to the end of its life. Of course, the warning information Y< the photosensitive-member life information R.

After the completion of one job of the image forming operation by the steps 1 to 4, and further, after the completion of the updating of the integration value S stored in the photosensitive-member-damage-integration storage portion 25 of the storage means 30, the comparison portion 26 reads in the warning information Y and the life information R set in advance from the photosensitive-member-life-information storage portion 27 of the storage means 30 (step S7), reads in the updated integration value S from the photosensitive-member-damage integration storage portion 25 of the storage means 30, and first compares the photosensitive-damage integration value S and the warning information Y (step S5). As a result, when the updated photosensitive-member-damage-integration value S is smaller than the warning information Y (S<Y), the operation returns to the normal image forming sequence, and the life-warning information of the photosensitive member drum 1 is not displayed (step S8).

Next, as a result of comparing the photosensitive-member damage integration value S and the warning information Y in the step S5, if the photosensitive-member-damage integration value S is equal to or more than the warning information Y (S≧Y), the photosensitive-member-damage integration value S and the life information R are subsequently compared (step S6). As a result of the comparison in the step S6, if the photosensitive-member-damage integration value S is smaller than the life information R (S<R), this indicates that the end of life of the photosensitive member drum 1 is approaching. Thus, the usual image forming operation is continued, while, for example, an information transmitting means served by the comparison portion 26 sends a signal to a photosensitive-member-life-warning portion (display portion) which is a notifying means provided in the apparatus main body 101, and the photosensitive-member-life-warning portion (display portion) 28 instructs and urges the user to prepare the exchange (step S9). On the other hand, as a result of the comparison in the step S6, if the photosensitive-member-damage integration value S is equal to or more than the life information R (S≧R), the photosensitive-member-life-warning portion (display portion) 28 notifies the user of the end of life of the photosensitive-member drum 1, and instructs and urges the user to exchange the photosensitive member drum 1, and also the print operation is prevented (step S10). Then, when it is confirmed that the photosensitive-member drum 1 is exchanged, the print operation is again granted.

In this embodiment, the information to determine the life of the photosensitive-member drum 1 is set in two levels of the warning information Y and the life information R. It is needless to say that the user may be informed of more detailed life information of the photosensitive member by setting the levels with more levels.

In accordance with this embodiment described above, the life of the photosensitive-member drum 1, namely, that the electrophotographic photosensitive member has reached the end of its life or is approaching the end of its life, may be accurately detected, and the exchange time based on the life of the photosensitive-member drum 1 or that the exchange time is approaching may be accurately notified. Therefore, the satisfactory photosensitive-member drum 1 may always be used so that a satisfactory image may always be obtained.

Embodiment 3

Hereinafter, another embodiment of the present invention is explained. An image forming apparatus of this embodiment has basically the same structure as the image forming apparatus of Embodiment 1 shown in FIG. 1. Therefore, elements with the same functions and structures have the same reference numerals, and the detailed description there of is omitted.

In this embodiment, the photosensitive-member-damage-calculation-coefficient storage portion 29 inside the storage means 30 does not have the photosensitive-member-damage-calculation coefficients k1, k2, k3 and kd, but photosensitive-member-damage-calculation-coefficient selection information I. This photosensitive-member-damage-calculation-coefficient selection information I is, for example, formed of ten pieces of information I as shown in the photosensitive-member-damage-calculation-coefficient table of the table 1, and the pieces of photosensitive-member-damage-calculation-coefficient selection information I are related to the combination with the differing photosensitive-member-damage-calculation coefficients k1, k2, k3 and kd. This photosensitive-member-damage-calculation portion 24 selects one set from the combinations of the photosensitive-member-calculation coefficients k1, k2, k3 and kd and performs calculations based on the photosensitive-member-life-coefficient selection information I in the storage means 30, in accordance with the photosensitive-member-coefficient table of the table 1 that is set in advance and held.

TABLE 1

| Calculation coefficient selection information I | Coefficient k1 | k2 | k3 | kd |
|---|---|---|---|---|
| 0 | 1 | 0.3 | 0.1 | 0.3 |
| 1 | 1 | 0.4 | 0.1 | 0.3 |
| 2 | 1 | 0.5 | 0.1 | 0.3 |
| 3 | 1 | 0.6 | 0.1 | 0.3 |
| 4 | 1 | 0.3 | 0 | 0.3 |
| 5 | 1 | 0.4 | 0 | 0.3 |
| 6 | 1 | 0.5 | 0 | 0.3 |
| 7 | 1 | 0.6 | 0 | 0.3 |
| 8 | 0.8 | 0.3 | 0.1 | 0.3 |
| 9 | 0.5 | 0.3 | 0.1 | 0.2 |

First, the applied times t1, t2 and t3 of the respective bias applying conditions in one job of the image forming operation, and the time td when the developing roller 11 is in contact with the photosensitive-member drum 1 are detected in the time-detection portion 23 (step S1).

After one job of the image forming operation is completed, the applied times t1, t2 and t3 under the respective charging-bias applying conditions, the developing-roller contact time td, and the photosensitive-member-damage-calculation-coefficient selection information I stored in the photosensitive-member-damage-calculation-coefficient storage portion 29 of the storage means 30 of the drum unit 40 are handed over to the photosensitive-member-damage-calculation portion 24 (step S2). The photosensitive-member-damage-calculation portion 24 is coupled with the storage means 30 of the drum unit 40 in the state that the drum unit 40 is mounted to the apparatus main body 101. Here, the photosensitive-member-damage-calculation portion 24 selects one set of the calculation coefficients k1, k2, k3 and kd based on the photosensitive-member-damage-calculation-coefficient selection information I (step S3).

Next, the photosensitive-member-damage index D is calculated from the formula (1);

$$D=k1\times t1+k2\times t2+k3\times t3+kd\times td \quad (1)$$

(In this embodiment, the coefficients in the above formula are k1=1, k2=0.3, k3=0.1, kd=0.3 (where the photosensitive-member-damage-calculation-coefficient selection information I=0).) (step S4).

Further, the photosensitive-member-damage-calculation portion 24 adds the photosensitive-member-damage index D in one job to the photosensitive-member-damage integration value S stored in the storage means 30, and updates the photosensitive-member-damage integration value S (Snew=Sold+D) (step S5). This operation is repeated for every one job of the image forming operation.

When one job of the image forming operation is completed, and the updating of the integration value S stored in the photosensitive-member-damage-integration storage portion 25 of the storage means 30 of the drum unit 40 is completed, the comparison portion 26 reads in the life information R set and stored in advance from the photosensitive-member-life-information-storage portion 27 of the storage means 30 of the drum unit 40 (step S8), reads in the updated integration value S from the photosensitive-member-damage-integration-storage portion of the storage means 30, and compares the size relationship between the life information R and the integration value S (step S6).

When the result of the comparison in the step S6 shows that the updated integration value S is equal to or more than the life information R (S≧R), a signal is sent to the photosensitive-member-life-warning portion (display portion) 28 provided in the apparatus main body 101, indicating that the photosensitive-member drum 1 has reached the end of its life, such information being displayed or warning the user, and the image forming operation of the main body is forbidden (step S7).

When the result of the comparison in the step S6 shows that the photosensitive-member-damage-integration value S is smaller than the life information R (S<R), warning or displaying is not particularly performed, and the operation returns to the normal operation (step S9).

In this embodiment, the photosensitive-member calculation coefficients k1, k2, k3 and kd are not stored in the storage means 30 of the drum unit 40, and by storing the photosensitive-member-coefficient selection information I, the information held in the storage means 30 may be reduced. Thus, the capacity of the storage means may be reduced, and the cost of the storage means may be made lower.

Note that, in this embodiment, the photosensitive-member-calculation-coefficient selection information I inside the storage means 30 was passed to the photosensitive-member-damage-calculation portion 24 for every one job in the image formation, but the information may be passed just once when the power source of the apparatus main body 101 is turned ON.

According to the present invention, the user may be accurately notified of the life of the photosensitive-member drum 1, namely, that the electrophotographic photosensitive member has reached the end of its life may be accurately detected, and the exchange time based on the life of the photosensitive member drum 1. Therefore, since the satisfactory photosensitive member drum 1 may always be used, a satisfactory image may always be obtained. Further, with the structure of this embodiment, the memory capacity provided in a cartridge may be made smaller.

Embodiment 4

Hereinafter, still another embodiment of the present invention is explained. An image forming apparatus of this embodiment has basically the same structure as the image forming apparatus of Embodiment 1 shown in FIG. 1. Therefore, elements with the same functions have the same reference numerals, and the detailed description thereof is omitted.

In this embodiment, as in Embodiment 2, information to determine the life of the photosensitive member is set in two levels. In this embodiment, the levels are warning information Y for instructing and urging the user to exchange at the time when the end of life of the photosensitive member drum 1 is approaching, and life information R, which is the real photosensitive member life. Of course, the size relationship is expressed as the warning information Y< the life information R.

Further, in this embodiment, the photosensitive-member-life-information storage portion 27 of the storage means 30 inside the drum unit 40 is stored with photosensitive-member-life selection information J instead of the warning information Y and the life information R. This photosensitive-member-life-selection information J is, for example, formed of ten pieces of life-selection information J as shown in the photosensitive-member-life information table of the table 2, and the pieces of photosensitive-member-life-selection information J are related to different combinations of the warning information Y and the life information R. In this embodiment, the comparison portion 26 holds the photosensitive-member-life-information table showing the relationship between the photosensitive-member-life-selection information J shown in the table 2, and the warning information Y and the life information R. Further, the comparison portion 26 selects one set from the combinations of the warning information Y and the life information R, in accordance with the photosensitive-member-life-selection information J read in from the storage means 30 of the drum unit 40.

TABLE 2

| | Life, Warning | |
|---|---|---|
| Life selection information J | Warning information Y | Life information R |
| 0 | 100000 | 150000 |
| 1 | 200000 | 300000 |
| 2 | 100000 | 120000 |
| 3 | 100000 | 200000 |
| 4 | 100000 | 160000 |
| 5 | 100000 | 170000 |
| 6 | 100000 | 180000 |
| 7 | 140000 | 150000 |
| 8 | 145000 | 150000 |
| 9 | 190000 | 200000 |

First, the applied times t1, t2, t3 under the respective bias applying conditions in one job of the image forming operation, and the time td in which the developing roller 11 is in contact with the photosensitive member drum 1 are detected by the time-detection portion 23 (step S1).

After one job of the image forming operation is completed, the applied times t1, t2 and t3 under the respective charging bias applying conditions, the developing-roller contact time td, and the photosensitive-member-damage-calculation coefficients k1, k2, k3, kd stored in the photosensitive-member-damage-calculation-coefficient storage portion 29 in the storage means 30 of the drum unit 40 are handed over to the photosensitive-member-damage-calculation portion 24 (step S2). Here, the photosensitive-member-damage-calculation portion 24 is coupled with the storage means 30 in the drum unit 40 in a state that the drum unit 40 is mounted to the apparatus main body 101.

Next, the photosensitive member damage index D is calculated by the formula (1), $$D=k1\times t1+k2\times t2+k3\times t3+kd\times td \quad (1)$$

(In this embodiment, the coefficients in the above formula are k1=1, k2=0.3, k3=0.1, kd=0.3) (step S3).

Further, the photosensitive-member-damage calculation portion 24 adds the photosensitive-member-damage index D in one job to the photosensitive-member-damage-integration value S stored in the storage means 30, and updates the photosensitive-member-damage-integration value S (Snew=Sold+D) (step S4). This operation is repeated for every one job of the image forming operation.

When one job of the image forming operation is completed, and the updating of the integration value S stored in the photosensitive-member-damage-integration storage portion 25 of the storage means 30 of the drum unit 40 is completed, the comparison portion 26 reads out the photosensitive-member-life-selection information J from the photosensitive-member-life-information storage portion 27 of the storage means 30 (step S5), and selects the warning information Y and the life information R from the photosensitive-member-life-information table shown in the table 2 in accordance with the photosensitive-member-life-selection information J (step S6). On the other hand, the updated photosensitive-member-damage-integration value S is read in from the photosensitive-member-damage-integration storage portion 25, and first the updated photosensitive-member-damage-integration value S and the warning information Y are compared (step S7).

As a result of the comparison in the step S7, if the updated photosensitive-member-damage-integration value S is smaller than the warning information Y (S<Y), the operation returns to the normal image forming sequence, and the life warning information of the photosensitive member drum 1 is not displayed (step S8). On the other hand, as a result of the comparison in the step S7, if the photosensitive-member-damage-integration value S is equal to or more than the warning information Y (S≧Y), the photosensitive-member-damage-integration value S and the life information R are compared next (step S9).

As a result of the comparison in the step S9, if the photosensitive-member-damage-integration value S is smaller than the life information (S<R), it indicates that the end of life of the photosensitive member drum 1 is approaching and the photosensitive-member-life warning portion (display portion) 28 instructs and urges the user to prepare for exchange (step S10). On the other hand, as a result of the comparison in the step S9, if the photosensitive-member-damage-integration value S is equal to or more than the life information (S≧R), the user is notified that the end of life of the photosensitive member has been reached in the warning portion (display portion) 28, and instructed to urge the exchange of the photosensitive member drum 1, and the image forming operation is stopped (step S11). Then, when it is confirmed that the photosensitive member drum 1 is newly exchanged, the print operation is again allowed.

In this embodiment, by storing not the warning information Y and the life information R but the photosensitive-member-life selection information J in the storage means 30, the information held in the storage means 30 may be reduced, the capacity of the storage means 30 may be reduced, and the cost of the storage means may be made lower.

Note that, in this embodiment, the photosensitive-member-life selection information J in the storage means 30 is passed to the comparison portion 26 for every one job of the image forming operation, but the information may be passed only once when the power source of the apparatus main body 101 is turned ON.

In accordance with this embodiment, the life of the photosensitive member drum 1, namely, that the electrophotographic photosensitive member has reached the end of its life or is approaching the end of its life may be accurately detected, and the user may be accurately notified of the exchange time based on the life of the photosensitive member drum 1, or that the exchange time is approaching. Accordingly, a satisfactory photosensitive member drum 1 may always be used, and a satisfactory image may always be obtained. Also, with the structure of this embodiment, the capacity of a cartridge may be made smaller.

Embodiment 5

Figure 9:
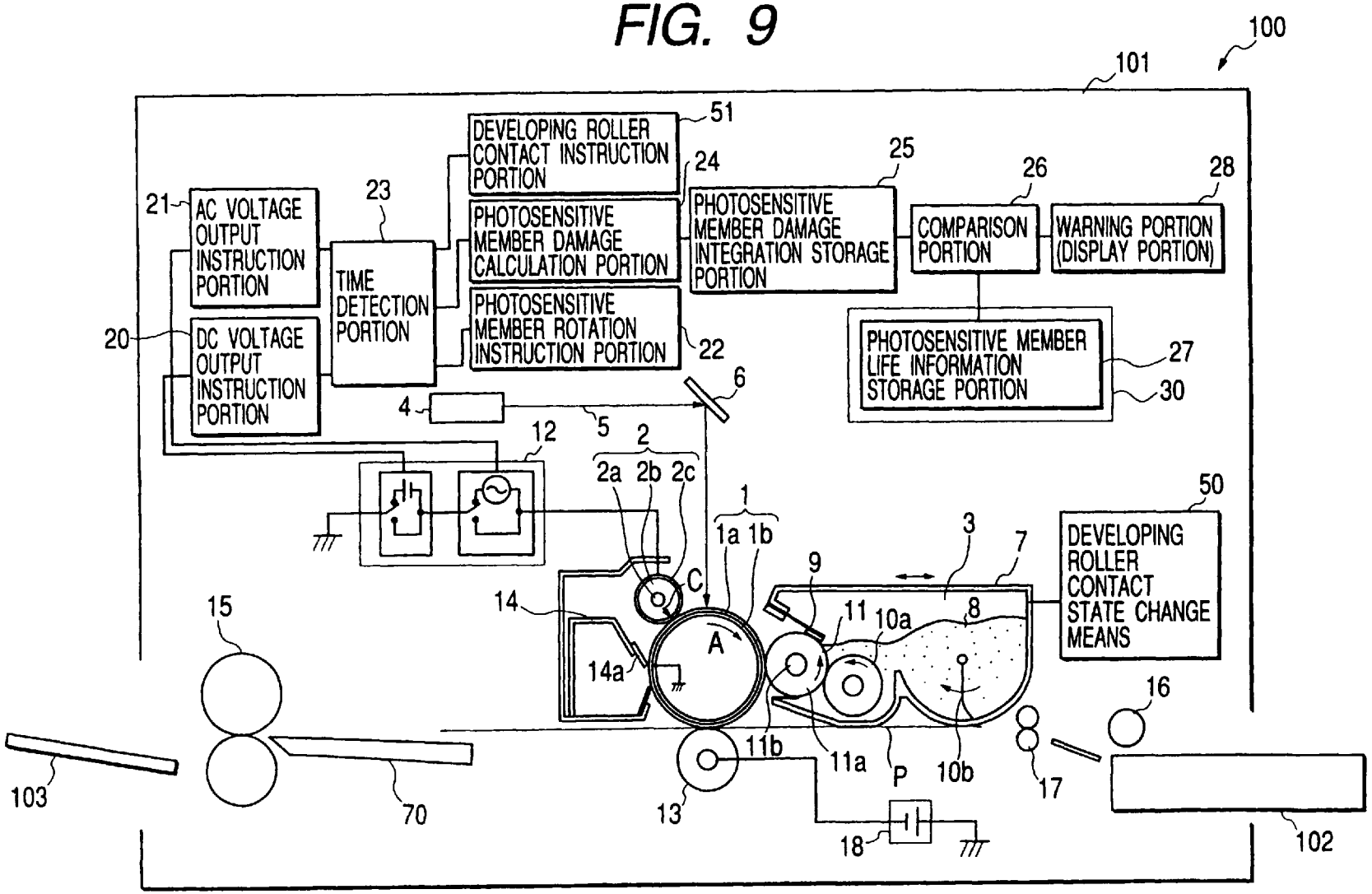
FIG. 9 is a schematic structural diagram of another embodiment of an image forming apparatus of the present invention.

In the image forming apparatuses of Embodiments 1 to 4 described above, as a cartridge detachably attachable to the apparatus main body 101, the drum unit including at least the photosensitive member drum (process cartridge) 40 is made detachably attachable with the apparatus main body 101, and the structure is made such that the storage means 30 is mounted on the drum unit 40. However, in this embodiment, as shown in FIG. 9, instead of an integral-type-process-cartridge structure, in a structure in which process means of the electrophotographic image formation apparatus (electrophotographic photosensitive member, charging means, developing means, and cleaning means) are each mounted to the image-forming-apparatus main body 101, the photosensitive-member-damage-integration storage portion 25, the photosensitive-member-life-information storage portion 27, and the like are respectively mounted on the apparatus main body 101. Note that, the photosensitive-member-damage-integration storage portion 25 and the photosensitive-member-life-information storage portion 27 may of course be integrated with the storage means 30. Further, the photosensitive-member-damage-calculation-coefficient information (ki, kd) is held in the photosensitive-member-damage-calculation portion 24 in this embodiment.

Note that, even if the photosensitive-member-damage-calculation coefficients (ki, kd) are held as the photosensitive-member-damage-calculation-coefficient information, an arbitrary means for identifying the photosensitive member drum 1 to be mounted on the apparatus main body 101 is provided, namely, the means corresponding to the photosensitive-member-damage-calculation-coefficient selection information I explained in Embodiment 3 is held in the photosensitive member drum 1, (for example, input from the input portion of the apparatus main body at the time of mounting of the photosensitive member drum 1, and mechanical identification of the type of each photosensitive member drum 1 can be performed). Thus, the structure may be such that one of the combinations of the plurality of photosensitive-member-damage-calculation coefficients (ki, kd) is selected for use.

In this embodiment, by applying the process explained in Embodiments 1 to 4, substantially the same operation effect as Embodiments 1 to 4 may be obtained. Note that, for the explanations, the explanation of Embodiments 1 to 4 will be referenced.

Note that, in each of Embodiments described above, it is explained that the warning portion (display portion) 28 as a notifying means provided in the apparatus main body 101 as the notifying means to notify the user that the photosensitive member drum 1 has reached its end of its life, or is approaching the end of its life. However, the present invention is not limited thereto, and for example, a screen (display) of equipment such as a host computer, which is connected to have communication with the image forming apparatus main body 101, may be used as a notifying means. Further, as a notifying means, notification by a warning message or a voice, and recording to the recording medium and output are of course also possible. Any notifying method may be adopted as long as the user is notified of the end of the life of the image bearing member or that the end of the life is near, and can tell the appropriate exchange time of the image bearing member, that the time is near, etc.

As described above, the above method of detecting the end of the life of an image bearing member is structured to judge the life of the image bearing member by: (a) calculating the image-bearing-member damage index D showing the exhaustion degree of the image bearing member by using the applied times for the respective conditions of the charging bias applied to the charging means for forming an electrostatic image on the image bearing member and/or the contact time of the developing means for developing the electrostatic image on the image bearing member; (b) integrating the image-bearing-member damage index D and storing it as the image-bearing-member-damage-integration value S; and (c) comparing the image-bearing-member-damage-integration value S and the life information R that corresponds to the image bearing member damage integration value S in the life of the image bearing member that is previously set. Further, the image forming apparatus of the present invention that adopts the above method comprises: the image bearing member; the charging means for charging the image bearing member under the n types ($n \geqq 1$) of charging bias conditions i (i=1 to n); the developing means performing developing by contacting the image bearing member; the time detection means for detecting the time ti when the charging bias is applied to the charging means under the charging bias condition i (i=1 to n) and the contact time td to the image bearing member of the developing means; the calculation means for calculating the damage index D of the image bearing member based on the formula, $$D = \sum_{i=1}^{n} (ki \times ti) + (kd \times td)$$

(where, k1>0, ki (i=2 to n)$\geqq$0, kd$\geqq$0), using the detected times ti (i=1 to n) and td, and the coefficients ki(i=1 to n) and kd; the integration means for obtaining the image-bearing-member-damage-integration value S by integrating the image-bearing-member-damage index D; and the comparison means for comparing the image-bearing-member-damage-integration damage integration value S and the life information R that corresponds to the image-bearing-member-damage-integration value S in the life of the image bearing member that is previously set. Further, since the cartridge detachably attachable to the image forming apparatus is also provided, that the image bearing member has reached the end of its life or is approaching the end of its life may be accurately detected, and the user is accurately notified of the exchange time based on the life of the image bearing member or that the exchange time is near. According to the present invention, that the image bearing member has reached the end of its life or is approaching the end of its life may be accurately detected particularly in a case where the image bearing member is charged with the plurality of charging conditions and the developing means may be in contact with or have a clearance with the image bearing member.

In this embodiment, by storing not the warning information Y and the life information R but the photosensitive-member-life selection information J in the storage means 30, the information held in the storage means 30 may be reduced, the capacity of the storage means 30 may be reduced, and the cost of the storage means may be made lower.

Note that, in this embodiment, the photosensitive-member-life selection information J in the storage means 30 is passed to the comparison portion 26 for every one job of the image forming operation, but the information may be passed only once when the power source of the apparatus main body 101 is turned ON.

In accordance with this embodiment, the life of the photosensitive member drum 1, namely, that the electrophotographic photosensitive member has reached the end of its life or is approaching the end of its life may be accurately detected, and the user may be accurately notified of the exchange time based on the life of the photosensitive member drum 1, or that the exchange time is approaching. Accordingly, a satisfactory photosensitive member drum 1 may always be used, and a satisfactory image may always be obtained. Also, with the structure of this embodiment, the capacity of a cartridge may be made smaller.

Embodiment 5

In the image forming apparatuses of Embodiments 1 to 4 described above, as a cartridge detachably attachable to the apparatus main body 101, the drum unit including at least the photosensitive member drum (process cartridge) 40 is made detachably attachable with the apparatus main body 101, and the structure is made such that the storage means 30 is mounted on the drum unit 40. However, in this embodiment, as shown in FIG. 9, instead of an integral-type-process-cartridge structure, in a structure in which process means of the electrophotographic image formation apparatus (electrophotographic photosensitive member, charging means, developing means, and cleaning means) are each mounted to the image-forming-apparatus main body 101, the photosensitive-member-damage-integration storage portion 25, the photosensitive-member-life-information storage portion 27, and the like are respectively mounted on the apparatus main body 101. Note that, the photosensitive-member-damage-integration storage portion 25 and the photosensitive-member-life-information storage portion 27 may of course be integrated with the storage means 30. Further, the photosensitive-member-damage-calculation-coefficient information (ki, kd) is held in the photosensitive-member-damage-calculation portion 24 in this embodiment.

Note that, even if the photosensitive-member-damage-calculation coefficients (ki, kd) are held as the photosensitive-member-damage-calculation-coefficient information, an arbitrary means for identifying the photosensitive member drum 1 to be mounted on the apparatus main body 101 is provided, namely, the means corresponding to the photosensitive-member-damage-calculation-coefficient selection information I explained in Embodiment 3 is held in the photosensitive member drum 1, (for example, input from the input portion of the apparatus main body at the time of mounting of the photosensitive member drum 1, and mechanical identification of the type of each photosensitive member drum 1 can be performed). Thus, the structure may be such that one of the combinations of the plurality of photosensitive-member-damage-calculation coefficients (ki, kd) is selected for use.

In this embodiment, by applying the process explained in Embodiments 1 to 4, substantially the same operation effect as Embodiments 1 to 4 may be obtained. Note that, for the explanations, the explanation of Embodiments 1 to 4 will be referenced.

Note that, in each of Embodiments described above, it is explained that the warning portion (display portion) 28 as a notifying means provided in the apparatus main body 101 as the notifying means to notify the user that the photosensitive member drum 1 has reached its end of its life or is approaching the end of its life. However, the present invention is not limited thereto, and for example, a screen (display) of equipment such as a host computer, which is connected to have communication with the image forming apparatus main body 101, may be used as a notifying means. Further, as a notifying means, notification by a warning message or a voice, and recording to the recording medium and output are of course also possible. Any notifying method may be adopted as long as the user is notified of the end of the life of the image bearing member or that the end of the life is near, and can tell the appropriate exchange time of the image bearing member, that the time is near, etc.

As described above, the above method of detecting the end of the life of an image bearing member is structured to judge the life of the image bearing member by: (a) calculating the image-bearing-member damage index D showing the exhaustion degree of the image bearing member by using the applied times for the respective conditions of the charging bias applied to the charging means for forming an electrostatic image on the image bearing member and/or the contact time of the developing means for developing the electrostatic image on the image bearing member; (b) integrating the image-bearing-member damage index D and storing it as the image-bearing-member-damage-integration value S; and (c) comparing the image-bearing-member-damage-integration value S and the life information R that corresponds to the image bearing member damage integration value S in the life of the image bearing member that is previously set. Further, the image forming apparatus of the present invention that adopts the above method comprises: the image bearing member; the charging means for charging the image bearing member under the n types (n>1) of charging bias conditions i (i=1 to n); the developing means performing developing by contacting the image bearing member; the time detection means for detecting the time ti when the charging bias is applied to the charging means under the charging bias condition i (i=1 to n) and the contact time td to the image bearing member of the developing means; the calculation means for calculating the damage index D of the image bearing member based on the formula, $$D = \sum_{i=1}^{n} (ki \times ti) + (kd \times td)$$

(where, k1>0, ki (i=2 to n)≧0, kd≧0), using the detected times ti (i=1 to n) and td, and the coefficients ki(i=1 to n) and kd; the integration means for obtaining the image-bearing-member-damage-integration value S by integrating the image-bearing-member-damage index D; and the comparison means for comparing the image-bearing-member-damage-integration damage integration value S and the life information R that corresponds to the image-bearing-member-damage-integration value S in the life of the image bearing member that is previously set. Further, since the cartridge detachably attachable to the image forming apparatus is also provided, that the image bearing member has reached the end of its life or is approaching the end of its life may be accurately detected, and the user is accurately notified of the exchange time based on the life of the image bearing member or that the exchange time is near. According to the present invention, that the image bearing member has reached the end of its life or is approaching the end of its life may be accurately detected particularly in a case where the image bearing member is charged with the plurality of charging conditions and the developing means may be in contact with or have a clearance with the image bearing member.

What is claimed is:

1. A memory device provided in a process cartridge detachably attachable from to a main body of an image forming apparatus, the process cartridge being provided with an image bearing member, wherein developing means for developing an electrostatic latent image formed on the image bearing member with a developer is contactable with the image bearing member and capable of being spaced apart from the image bearing member, said memory device comprising:

a first memory portion configured to store data concerning the life of the image bearing member calculated by using information concerning the contact time during which the developing means is in contact with the image bearing member; and a second memory portion configured to store information concerning a parameter used for calculating the data stored in said first memory portion in accordance with the information concerning the contact time.

2. A memory device according to claim 1, wherein the parameter is a weighting factor for being multiplied by the information concerning the contact time.

3. A memory device according to claim 1, wherein the data is calculated by using information concerning the charging time while charging means charges the image bearing member.

4. A memory device according to claim 3, further comprising a third memory portion configured to store a second parameter which is a weighting factor for being multiplied by the information concerning the charging time.

5. A memory device according to claim 1, wherein the data is calculated by using information concerning a rotation time of the image bearing member.

6. A memory device according to claim 5, further comprising a third memory portion configured to store a second parameter which is a weighting factor for being multiplied by the information concerning the rotation time.

7. A memory device according to claim 1, further comprising a third memory portion configured to store information concerning the end of life of the image bearing member for comparison with the data stored in said first memory portion concerning the life of the image bearing member calculated by using information concerning the contact time during which the developing means is in contact with the image bearing member.

8. A memory device according to claim 1, wherein the parameter is capable of changing for different process cartridges to which said memory device is attached.

9. A memory device according to claim 3 or 4, wherein the charging means is positioned in contact with the image bearing member.

10. A memory device according to claim 9, wherein the charging means receives DC voltage.

11. A memory device according to claim 9, wherein the charging means receives AC voltage.

12. A memory device according to claim 3 or 4, wherein the process cartridge is provided with the charging means.

13. A memory device according to claim 1, wherein the process cartridge is provided with the developing means.

14. A memory device according to claim 1, wherein when the data is equal to or greater than a predetermined value, the main body of the image forming apparatus issues a notification thereof.

15. A memory device according to claim 1, wherein the data is an integrated value.

16. A memory device according to claim 1 or 2, wherein the information concerning the parameter is selection information for selecting the parameter.

17. A memory device according to claim 16, wherein the information concerning the parameter is stored in the main body of the apparatus.

18. A control system for controlling an image forming apparatus having a main body and a process cartridge detachable from and attachable to the main body, the process cartridge being provided with an image bearing member, wherein developing means for developing an electrostatic latent image formed on the image bearing member with a developer is contactable with the image bearing member and is capable of being spaced apart from the image bearing member, said control system comprising:

A) a memory device provided in the process cartridge having:

a first memory portion configured to store data concerning the life of the image bearing member calculated by using information concerning the contact time during which the developing means is in contact with the image bearing member; and a second memory portion configured to store a parameter used for calculating the data stored in said first memory portion in accordance with the information concerning the contact time; and B) calculation means for calculating the data stored in the first memory portion by using the information concerning the contact time and the parameter.

19. A control system according to claim 18, wherein the parameter is a weighting factor for being multiplied by the information concerning the contact time.

20. A control system according to claim 18, wherein the data is calculated by using information concerning the charging time while charging means charges the image bearing member.

21. A control system according to claim 20, wherein said memory device further comprises a third memory portion configured to store a second parameter which is a weighting factor for being multiplied by the information concerning the charging time.

22. A control system according to claim 18, wherein the data is calculated by using information concerning a rotation time of the image bearing member.

23. A control system according to claim 22, further comprising a third memory portion configured to store a second parameter which is a weighting factor for multiplying the information concerning the rotation time.

24. A control system according to claim 18, wherein said memory device further comprises a third memory portion configured to store information concerning the end of life of the image bearing member for comparison with the data stored in said first memory portion concerning the life of the image bearing member calculated by using information concerning the contact time during which the developing means is in contact with the image bearing member.

25. A control system according to claim 18, wherein the parameter is capable of changing for different process cartridges to which said memory device is attached.

26. A control system according to claim 20 or 21, wherein the charging means is positioned in contact with the image bearing member.

27. A control system according to claim 26, wherein the charging means receives DC voltage.

28. A control system according to claim 26, wherein the charging means receives AC voltage.

29. A control system according to claim 20 or 21, wherein the process cartridge is provided with the charging means.

30. A control system according to claim 18, wherein the process cartridge is provided with the developing means.

31. A control system according to claim 18, wherein when the data is equal to or greater than a predetermined value, the main body of the image forming apparatus issues a notification thereof.

32. A control system according to claim 18, wherein the data is an integrated value.

33. A control system according to claim 18 or 19, wherein the information concerning the parameter is selection information for selecting the parameter.

34. A control system according to claim 33, wherein the information concerning the parameter is stored in the main body of the apparatus.

35. A process cartridge detachably attachable to a main body of an image forming apparatus, comprising:

an image bearing member, wherein developing means for developing an electrostatic image formed on said image bearing member with a developer is contactable with said image bearing member and capable of being spaced apart from said image bearing member; and a memory device configured to store data concerning the life of said image bearing member in accordance with information concerning the contact time during which the developing means is in contact with said image bearing member.

36. A process cartridge according to claim 35, wherein said memory device stores a parameter used for calculating the data in accordance with the information concerning the contact time.

37. A process cartridge according to claim 35, wherein the data is calculated by using the information concerning the contact time.

38. A process cartridge according to claim 36, wherein the parameter is a weighting factor for being multiplied by the information concerning the contact time.

39. A process cartridge according to claim 35, wherein the data is calculated by using information concerning the charging time while charging means charges said image bearing member.

40. A process cartridge according to claim 39, wherein said memory device comprises a memory portion configured to store a parameter which is a weighting factor for being multiplied by the information concerning the charging time.

41. A process cartridge according to claim 35, wherein the data is calculated by using information concerning a rotation time of said image bearing member.

42. A process cartridge according to claim 41, wherein said memory device comprises a memory portion configured to store a parameter which is a weighting factor for multiplying the information concerning the rotation time.

43. A process cartridge according to claim 35, wherein said memory device comprises a memory portion configured to store information concerning the end of life of said image bearing member for comparison with the data stored in said memory device concerning the life of the image bearing member calculated by using information concerning the contact time during which the developing means is in contact with said image bearing member.

44. A process cartridge according to claim 36, wherein the parameter is capable of changing depending on the process cartridges to which said memory device is attached.

45. A process cartridge according to claim 39 or 40, wherein the charging means is positioned in contact with said image bearing member.

46. A process cartridge according to claim 45, wherein the charging means receives DC voltage.

47. A process cartridge according to claim 45, wherein the charging means receives AC voltage.

48. A process cartridge according to claim 39 or 40, wherein said process cartridge is provided with the charging means.

49. A process cartridge according to claim 45, wherein said process cartridge is provided with the developing means.

50. A process cartridge according to claim 35, wherein when the data is equal to or greater than a predetermined value, the main body of the image forming apparatus issues a notification thereof.

51. A process cartridge according to claim 35, wherein the data is an integrated value.

52. A process cartridge according to claim 36, wherein said memory device stores information concerning the parameter comprising selection information for selecting the parameter.

53. A process cartridge according to claim 52, wherein the parameter is stored in the main body of the apparatus.

* * * * *

UNITED STATES PATENT AND TRADEMARK OFFICE

CERTIFICATE OF CORRECTION

PATENT NO. : 6,704,524 B2
DATED : March 9, 2004
INVENTOR(S) : Minoru Matsuguma et al.

It is certified that error appears in the above-identified patent and that said Letters Patent is hereby corrected as shown below:

Column 1,
Line 24, “include,” should read -- includes, --.

Column 10,
Line 57, “exist” should read -- exists --.

Column 14,
Lines 1 to 19, should be deleted.

Column 21,
Line 36, “image bearing member damage integra-” should read -- image-bearing-member-damage-integra- --.
Line 62, “damage intergration” should be deleted.

Column 22,
Lines 12 to 67, should be deleted.

Column 23,
Lines 1 to 67, should be deleted.

Signed and Sealed this

Thirteenth Day of July, 2004

JON W. DUDAS
*Acting Director of the United States Patent and Trademark Office*